US006394057B1

(12) United States Patent
Fukuoka et al.

(10) Patent No.: US 6,394,057 B1
(45) Date of Patent: May 28, 2002

(54) ARRANGEMENT OF COMPONENTS FOR ENGINE

(75) Inventors: Yoshihito Fukuoka; Hiroshi Oishi, both of Shizuoka (JP)

(73) Assignee: Sanshin Kogyo Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/491,359

(22) Filed: Jan. 26, 2000

(30) Foreign Application Priority Data

Jan. 26, 1999 (JP) ..... 11-017649
Feb. 1, 1999 (JP) ..... 11-024453

(51) Int. Cl.[7] ..... F02F 7/00

(52) U.S. Cl. ..... 123/195 P; 123/41.08; 123/184.38

(58) Field of Search ..... 123/184.38, 184.39, 123/184.41, 41.08, 41.09, 195 P, 195 HC

(56) References Cited

U.S. PATENT DOCUMENTS 1,364,543 A * 1/1921 Calow ..... 123/184.41
2,445,684 A * 7/1948 Malbry ..... 123/41.08
3,358,654 A * 12/1967 Shanahan ..... 123/41.08
4,399,797 A 8/1983 Iwai
5,036,804 A 8/1991 Shibata
5,048,467 A 9/1991 Kojima
5,109,809 A 5/1992 Fujimoto
5,251,577 A 10/1993 Kojima
5,261,356 A 11/1993 Takahashi et al.
5,524,584 A 6/1996 Watanabe ..... 123/184.38
5,555,855 A 9/1996 Takahashi
5,673,655 A * 10/1997 Mishima ..... 123/195 HC
5,713,771 A 2/1998 Takahashi et al.
5,769,038 A 6/1998 Takahashi et al.
5,803,023 A 9/1998 Takahashi et al.
5,823,835 A 10/1998 Takahashi et al.
5,873,330 A 2/1999 Takahashi et al.
5,890,461 A 4/1999 Iikura
5,941,205 A 8/1999 Hiraoka et al.
5,950,425 A 9/1999 Takahashi et al.

FOREIGN PATENT DOCUMENTS

EP 0 658 687 A1 6/1995

* cited by examiner

*Primary Examiner*—Noah P. Kamen
(74) *Attorney, Agent, or Firm*—Knobbe, Martens, Olson & Bear, LLP

(57) ABSTRACT

An arrangement of components for an engine includes an improved construction. An exhaust system of the engine has an exhaust manifold extending along an cylinder body. At least a part of an air induction system of the engine exists to overlap with the exhaust manifold in a view along an extending axis of the exhaust manifold. A cooling system having at least two coolant passages is further provided. A coolant flow control mechanism is arranged to prevent only the coolant within one of the passages from flowing therethrough when temperature of the coolant is lower than a predetermined temperature.

30 Claims, 18 Drawing Sheets

ARRANGEMENT OF COMPONENTS FOR ENGINE

BACKGROUND OF THE INVENTION

1. Field of the Invention

This invention relates to an arrangement of components for an engine, and particularly to an arrangement of an air intake system, an exhaust system and a cooling system for an engine.

2. Description of Related Art

There are various kinds of arrangements for an engine in disposing its air intake system and an exhaust system. One of the most typical arrangements is a cross-flow type in which the air intake system and the exhaust system are disposed on the opposite sides of the engine relative to each other. Another arrangement, which is not so typical but is well known, is a counter-flow type in which, unlike the cross-flow type, the air intake system and the exhaust system are disposed on the same side of the engine.

One advantage of the counter-flow type is that an intake air charge is easily warmed up by the heat of the burnt charge or exhaust gasses because the air intake passage is positioned in proximity to the exhaust passage. This is advantageous to expedite engine warm up particularly under a cold condition.

Another advantage of the counter-flow type is that there is room on the counter side where neither intake nor exhaust system exists and other engine components can be disposed on this side. Otherwise, this side of the engine can be placed in close proximity to an inner wall of an engine compartment or a protective cowling, if it is incorporated in an outboard motor.

The engine comprises a cylinder body defining a cylinder bore or cylinder bores in which a piston or pistons reciprocate and a cylinder head affixed on an end of the cylinder body. The cylinder head define a combustion chamber or combustion chambers with the piston(s) and the cylinder bore(s). Generally, part of the air intake system and the exhaust system are disposed in the cylinder head. Because both of the systems are positioned on the same side of the engine in the counter-flow type as described above, these systems occupy a relatively large space. This causes the engine to be large.

It is, therefore, an object of the present invention to provide an engine employing the counter-flow arrangement as compact as possible.

On the other hand, the engine usually includes a cooling system arranged to cool the cylinder body and the cylinder head. The cylinder head constitutes a large part of the combustion chamber, and consequently it requires to be cooled more than the cylinder body. In addition, although the counter-flow arrangement is advantageous to expedite warming up of the air intake system, the high-temperature exhaust gasses passing through the passages of the exhaust system conversely tend to overheat the passages of the air intake system under a steady running condition. The air charges passing through the air intake system are hence overheated and the charging efficiency of the engine is deteriorated accordingly.

Additionally, if the cylinder body is overheated, abnormal combustion such as, for example, a knocking phenomenon, is likely to occur. If the cylinder body is overcooled, however, the viscosity of lubricant is increased and thus may prevent the piston from reciprocating smoothly.

It is, therefore, another object of the present invention to provide an engine that has a cooling system that sufficiently cools the cylinder head, including the intake passage formed therein, without overcooling the cylinder body.

Where the cylinder body has a plurality of cylinder bores and both of the air intake and exhaust system have a plurality of passages, it is advantageous for compactness of the engine to dispose one or more intake passages between the exhaust passages. In this arrangement, however, two groups of intake passages with different warm up characteristics result. One group of the intake passages is heated up by the exhaust passages, while the other group is not so warmed. The former group of the intake passages thus is hotter than the latter group. This imbalance of temperature between the intake passages tends to cause an imbalance between the outputs of the cylinders. As a result, the engine's performance can be adversely affected.

It is, therefore, a further object of the present invention to provide an engine having a cooling system that cools an air intake passage(s) disposed between exhaust passages more than the other intake passages that are positioned outside the exhaust passages.

SUMMARY OF THE INVENTION

In accordance with one aspect of the present invention, an internal combustion engine comprises a cylinder body defining a plurality of cylinder bores in which pistons reciprocate. A cylinder head is affixed to an end of the cylinder body and defines combustion chambers with the pistons and the cylinder bores. A plurality of air intake passages are provided for supplying air charges to the combustion chambers. The air intake passages includes inner sections defined within the cylinder head and outside sections disposed outside of the cylinder head. A plurality of exhaust passages are provided for discharging burnt charges from the combustion chambers. An exhaust manifold is provided for collecting the burnt charges from the exhaust passages. The exhaust manifold extends generally along the cylinder body and has an end portion in a direction of its extending axis. At least one of the outside sections of the air intake passages has a passage portion that is positioned adjacent to the end portion of the exhaust manifold. The passage portion overlaps with the exhaust manifold. In a preferred configuration, the passage portion overlaps the exhaust manifold in a view along the extending axis (e.g., a portion of the passage portion is disposed directly above a portion of the exhaust manifold). This engine layout provides a compact configuration.

In accordance with another aspect of the present invention, an internal combustion engine comprises a cylinder body defining at least one cylinder bore in which a piston reciprocates. A cylinder head is affixed to an end of the cylinder body and defines at least one combustion chamber with the piston and the cylinder bores. An air intake passage is provided for supplying an air charge to the combustion chamber. The air intake passage includes an inner section defined within the cylinder head. A cooling system is provided for supplying coolant at least to the cylinder body and to the cylinder head. The cooling system includes a first coolant passage disposed at least within the cylinder body and a second coolant passage disposed in proximity to the inner section of the air intake passage within the cylinder head. A coolant flow control mechanism is arranged to permit the coolant flowing through both of the first and second coolant passages. The coolant flow control mechanism prevents only the coolant within the first coolant passage from flowing therethrough when temperature of the coolant is lower than a preset temperature.

In accordance with a further aspect of the present invention, an internal combustion engine comprises a cylinder body defining a plurality of cylinder bores in which pistons reciprocate. A cylinder head is affixed to an end of the cylinder body and defines combustion chambers with the pistons and the cylinder bores. A plurality of air intake passages are provided for supplying air charges to the combustion chambers. The air intake passages include inner sections defined within the cylinder head and outside sections disposed outside of the cylinder head. A plurality of exhaust passages are provided for discharging burnt charges from the combustion chambers. A cooling system is provided for supplying coolant at least to the cylinder body and to the cylinder head. The cooling system includes a first coolant passage disposed at least within the cylinder body and a second coolant passage disposed in proximity to the inner sections of the air intake passages within the cylinder head. At least one of the intake passages is disposed between the exhaust passages. The second coolant passage is positioned closer to the intake passage, which is disposed between the exhaust passages, than to the other intake passages which are not disposed between the exhaust passages.

For purposes of summarizing the invention and the advantages achieved over the prior art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiment which follows.

BRIEF DESCRIPTION OF THE DRAWINGS

These and other features of this invention will now be described with reference to the drawings of a preferred embodiment which is intended to illustrate and not to limit the invention. The drawings contain the following figures.

DETAILED DESCRIPTION OF THE PREFERRED EMBODIMENTS OF THE INVENTION

Figure 1:
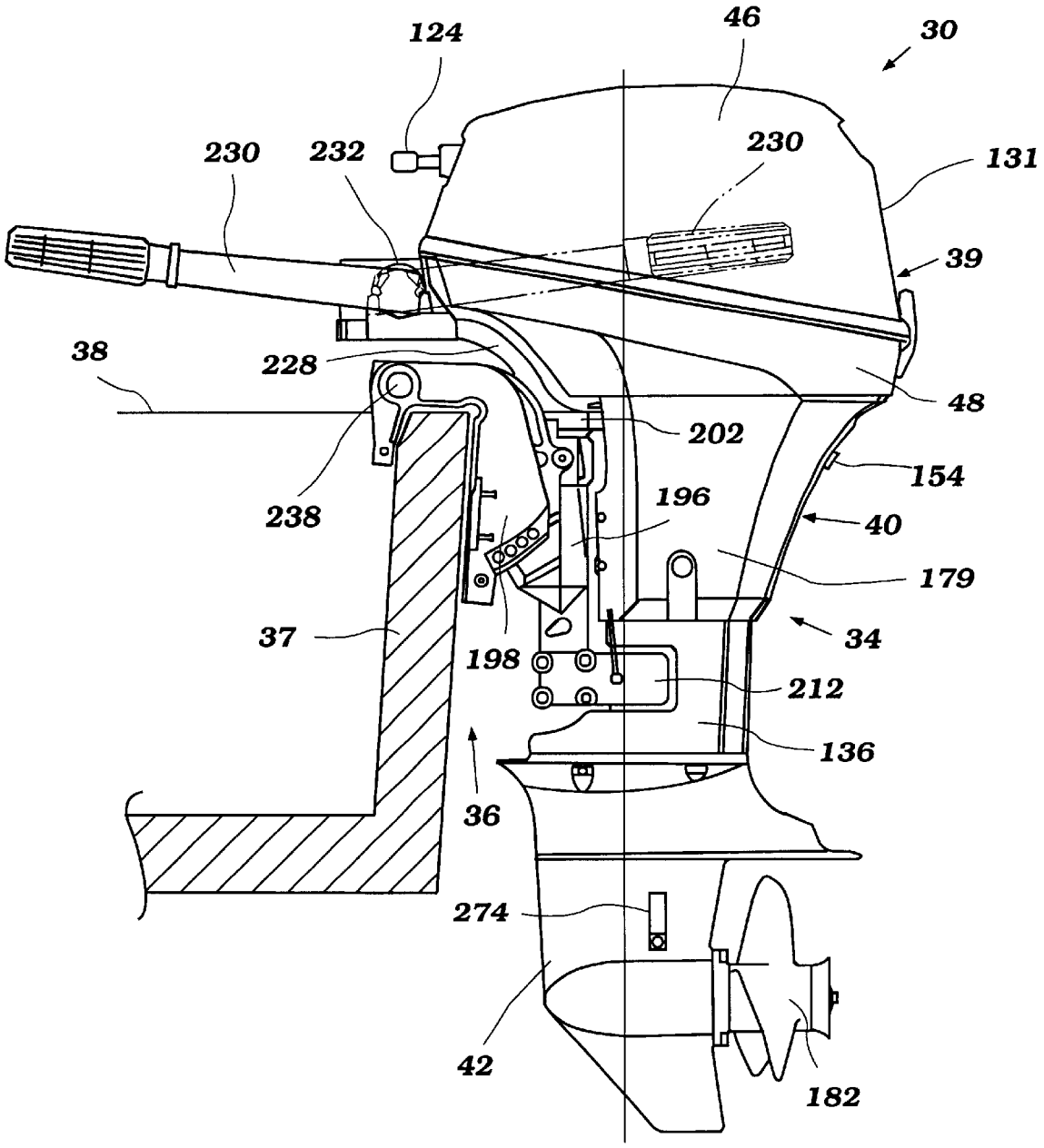
FIG. 1 is a side elevational view showing an outboard motor configured in accordance with a preferred embodiment of the present invention. The figure displays its portside structure of the outboard motor. An associated watercraft also is partially shown in section.

An outboard motor, designated generally by reference numeral 30, includes an internal combustion engine 32 arranged in accordance with a preferred embodiment of this invention. Although the present invention is shown in the context of an engine for an outboard motor, various aspects and features of the present invention also can be employed with other engines such as, for example, watercraft, all terrain vehicles, automobile and motorcycle engines.

In the illustrated embodiment, the outboard motor comprises a drive unit 34 and a bracket assembly 36. The drive unit 34 is affixed to a transom 37 of an associated watercraft 38 by the bracket assembly 36. The drive unit 34 includes a power head 39, a driveshaft housing 40 and a lower unit 42. The power head 39 is disposed atop of the drive unit 34 and includes the engine 32, a top protective cowling 46 and a bottom protective cowling 48.

The engine 32 operates on a four stroke combustion principle and powers a propulsion device. The engine 32 has a cylinder body or block 50. In the illustrated embodiment, the cylinder body 50 defines two cylinder bores 52 generally horizontally extending and spaced generally vertically with each other. That is, the engine 32 is a L2 (in-line 2 cylinder) type. This type of engine, however, is merely exemplary of a type in which various aspect and features of the present invention can be used. The engine, of course, can have other number of cylinders and certain aspects of the present invention can be used with engines having other configurations of cylinders.

Figure 9:
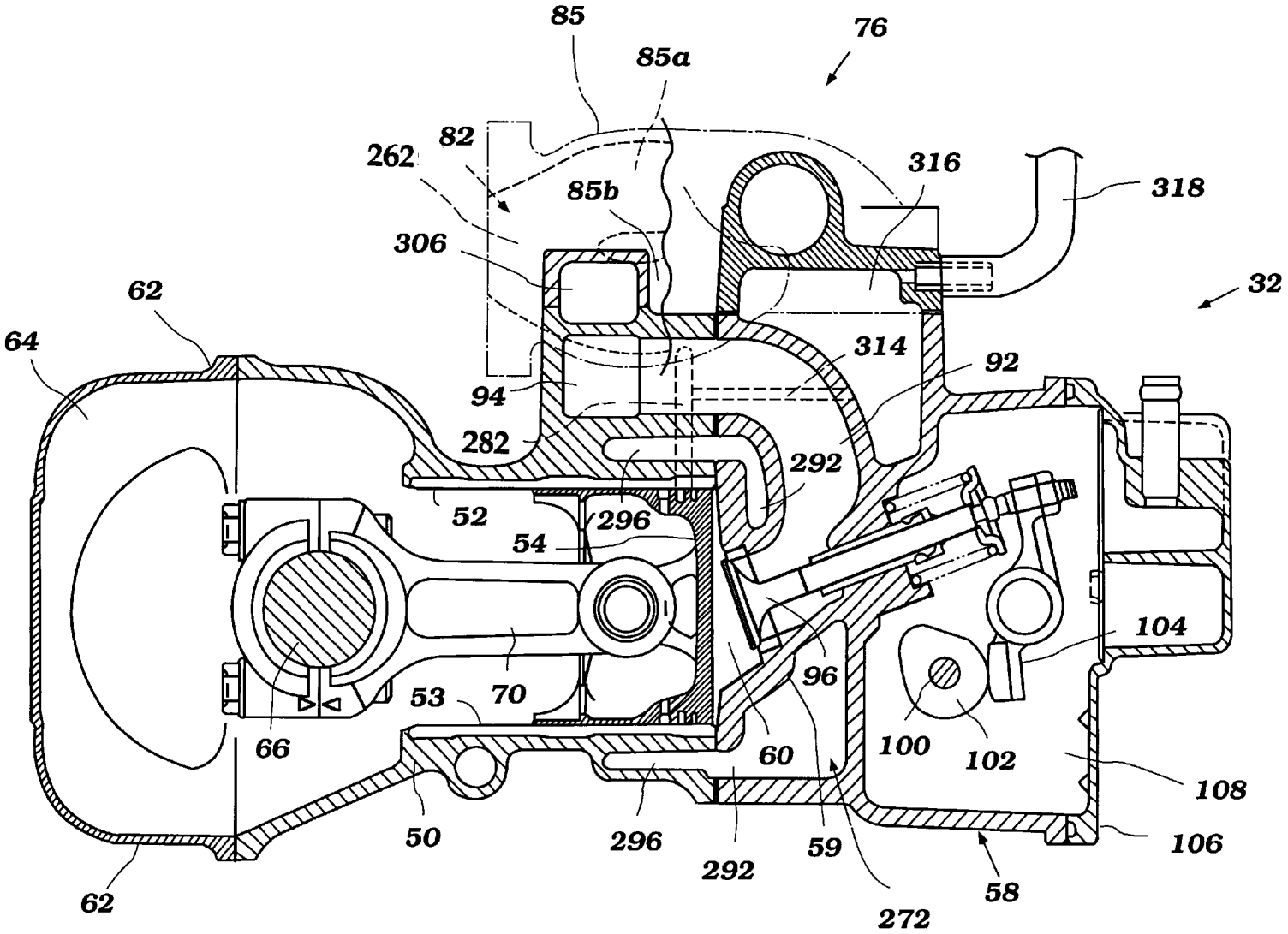
FIG. 9 is a cross-sectional top plan view showing the engine. An air intake system is illustrated in phantom.

As best seen in FIG. 9, a cylinder liner 53 is inserted within each cylinder of the cylinder body 50 and defines a cylinder bore 52. The term "cylinder bore" means a surface of this cylinder liner 53 in this description. A piston 54 can reciprocate in each cylinder bore 52. A cylinder head assembly 58, more specifically a cylinder head member 59, is affixed to one end of the cylinder body 50 and defines two combustion chambers 60 with the pistons 54 and the cylinder bores 52. The other end of the cylinder body 50 is closed with a crankcase member 62 defining a crankcase chamber 64 with the cylinder bores 52. A crankshaft or output shaft 66 extends generally vertically through the crankcase chamber 64. The crankshaft 66 is pivotally connected with the pistons 54 by connecting rods 70 and rotates with the reciprocal movement of the pistons 54. The crankcase member 64 is located at the most forward position of the powerhead 39, and the cylinder body 50 and the cylinder head assembly 58 extends rearwardly from the crankcase member 62 one after the other.

The engine 32 includes an air induction system 76 and an exhaust system 78. The air induction system 76 is arranged to supply air charges to the combustion chambers 60 and comprises an air intake section 80 and two air intake passages 82. Actually, the upstream portions of the air intake passages 82 are unified and defme a single intake manifold 84. Downstream portions of the intake passages 82 define an upper and lower intake runners 85*a*, 85*b*, although they are formed with a single runner member 85. Air inner portions 86, specifically upper and lower inner portions 86*a*, 86*b*, complete the air intake passages 82. Because the inner portions 86 are formed within the cylinder head member 59, they defme inner sections of the air intake passages 82. Meanwhile, the intake manifold 84 and the intake runner member 85 are placed outside of the cylinder head member 59 and hence they define outside sections thereof. The inner portions 86 are opened or closed by intake valves (not shown). When the inner portions 86 are opened, the air intake passages 82 communicate with the combustion chambers 60.

Carburetors 88 are interposed between the intake manifold 84 and the intake runner member 85 to supply fuel into the air intake passages 82. The carburetors 88 have throttle valves (not shown) therein. A fuel supply tank (not shown) is located on the associated watercraft 38 and the carburetors 88 are connected to the fuel supply tank. The air induction system 76 will be described in more detail below. The engine of course can include a fuel injection system (either direct or indirect) in the place of the carburetors, which are shown merely as one type of charge former that can be employed.

Figure 4:
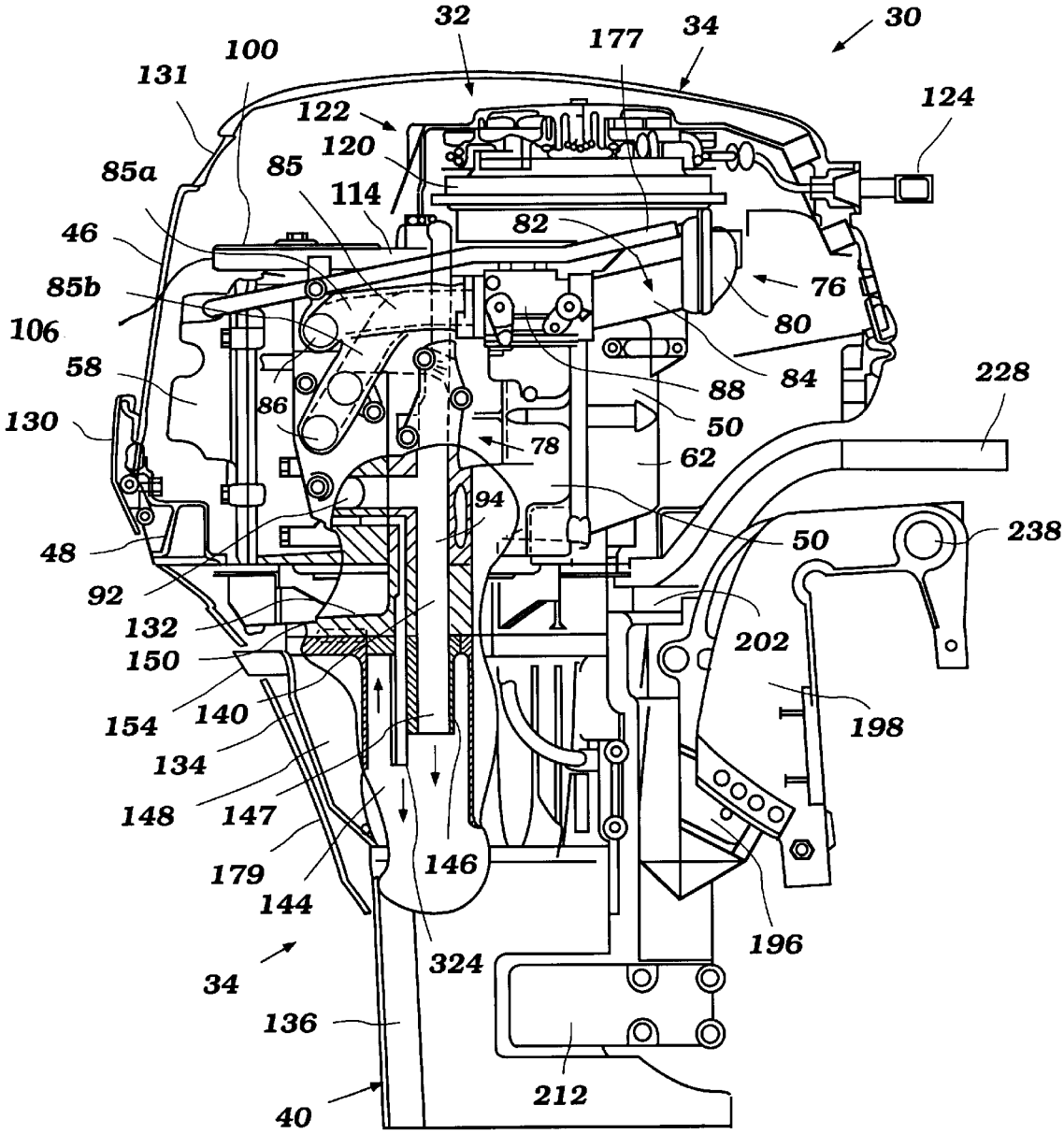
FIG. 4 is a cross-sectional, side elevational view showing a power head and the driveshaft housing of the outboard motor of FIG. 1. A starboard side structure thereof is illustrated. A lower part of the driveshaft housing is not sectioned. Conversely, an engine of the power head and an exhaust guide member and an upper part of the driveshaft housing are partially sectioned.
Figure 5:
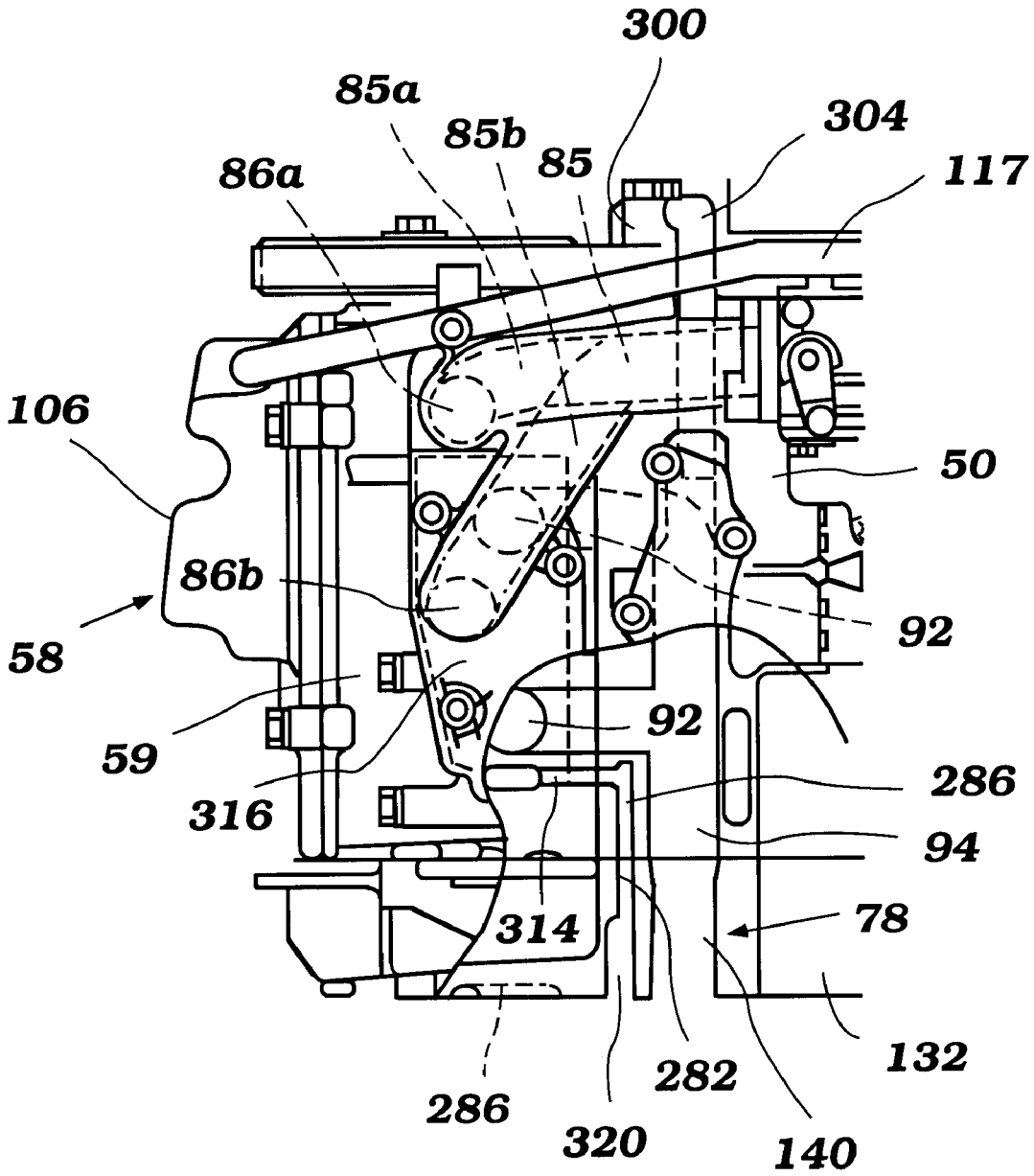
FIG. 5 is an enlarged sectional view showing the same power head. An intake and exhaust cooling jacket is indicated in dotted line.

As seen in FIGS. 4 and 5, the exhaust system 78 is arranged to discharge burnt charges or exhaust gasses from the combustion chambers 60 outside of the outboard motor 30. Exhaust ports 92 are formed in the cylinder head member 59 and define exhaust passages. The exhaust ports 92 are connected to an exhaust manifold 94 disposed within the cylinder body 50. The exhaust manifold 94 leads the exhaust gasses downstream of the exhaust system 78. The exhaust ports 92 are opened or closed by exhaust valves 96. When the exhaust ports 92 are opened, the combustion chambers 60 communicate with the exhaust manifold 94 that leads the exhaust gasses downstream in the exhaust system 78. The exhaust system 78 also will be described in more detail below.

A camshaft 100 extends generally vertically and is journaled on the cylinder head member 59 to activate the intake valves and the exhaust valves 96. As seen in FIG. 9, the camshaft 100 has cam lobes 102 thereon. Rocker arms 104 are interposed between the cam lobes 102 and the respective valves 96 to push the valves 96 open at a certain timing with the rotation of the camshaft 100. A return mechanism (e.g., a spring or a pneumatic or hydraulic lifter) bias the valves 96 closed. It is to be understood that the intake valves, which are not illustrated, are actuated in a similar manner.

Figure 2:
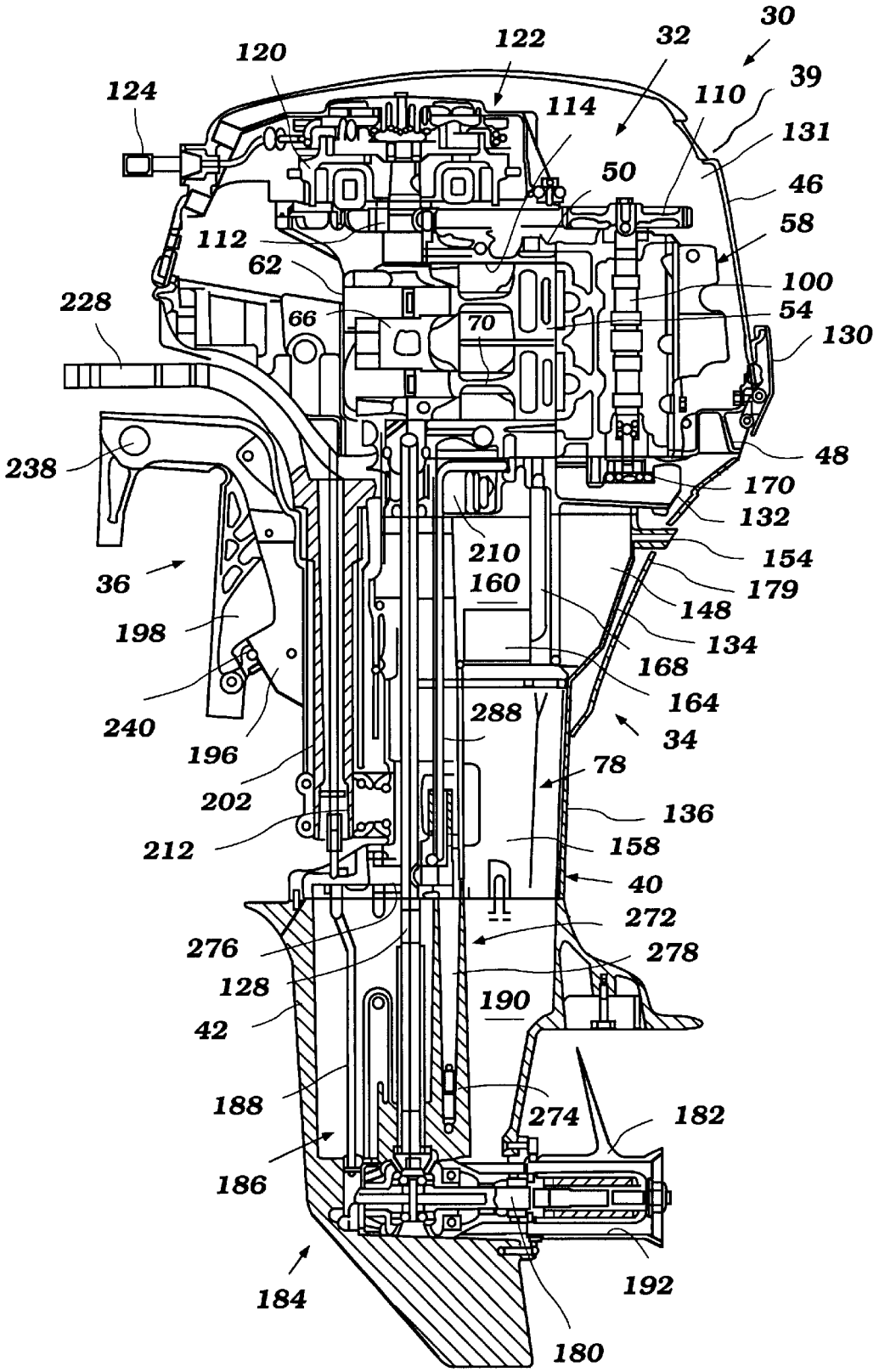
FIG. 2 is a cross-sectional, side elevational view showing the portside structure of the outboard motor of FIG. 1.

A cylinder head cover member 106 completes the cylinder head assembly 58. The cylinder head cover member 106 is affixed to the cylinder head member 60 to define a camshaft chamber 108 therebetween. The respective valves 96, cam lobes 102 and rocker arms 104 are omitted in FIG. 2.

Figure 8:
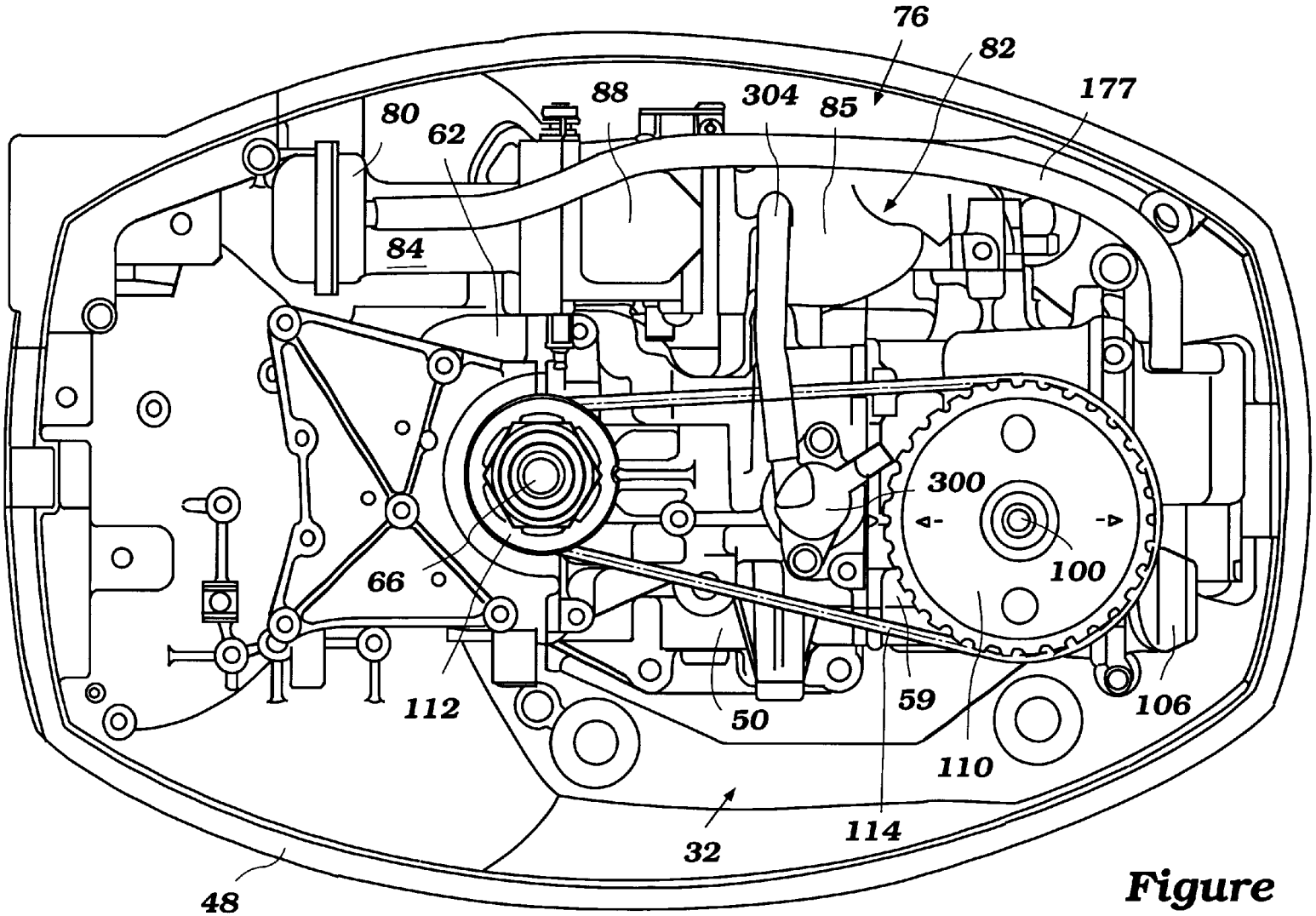
FIG. 8 is an enlarged top plan view showing the power head. A top cowling is removed in this figure.

As best seen in FIG. 8, the camshaft 100 is driven by the crankshaft 66. The camshaft 100 has a cogged pulley 110 thereon, while the crankshaft 66 also has a cogged pulley 112 thereon. The both pulleys 110, 112 are affixed to the respective shafts 100, 66 with nuts. A cogged or timing belt 114 is wound around the cogged pulleys 110, 112. With rotation of the crankshaft 66, therefore, the camshaft 100 rotates also.

Although not shown, the engine 32 further has a firing system. Two spark plugs are affixed on the cylinder head member 59 and exposed into the respective combustion chambers 60. The spark plugs fire an air/fuel charge at a certain firing timing to burn the air fuel charge.

A flywheel assembly 120 is affixed atop of the crankshaft 56. The flywheel assembly 120 includes a generator to supply electric power to the firing system and other electrical equipment. Additionally, the engine 32 includes a recoil starter 122. A starter lever 124 is provided outside of the top cowling 46. When the operator pulls the starter lever 124, the recoil starter 122 is actuated and starts the engine 32. While not illustrated, the engine also can include a starter motor in addition or in the alternative to the recoil starter. The use of a starter motor to drive the flywheel when starting the engine is preferred when the present invention is employed with larger size engines.

The top cowling 46 and the bottom cowling 48 generally completely enclose the engine 32 to protect it. The top cowling 46 is detachably affixed to the bottom cowling 48 with an affixing mechanism 130 so as to ensure access to the engine 32 for maintenance. The top cowling 46 has air intake openings 131 at its rear upper portion. Air can enter the interior of the cowlings 46, 48 and then it is introduced into the air induction system 76 through the air intake section 80.

The driveshaft housing 40 depends from the power head 39 and supports the engine 32 and a driveshaft 128 which is driven by the crankshaft 66. The driveshaft housing 40 comprises an exhaust guide member 132, an upper housing member 134 and a lower housing member 136. The exhaust guide member 132 is placed atop of these three members. The engine 32 is mounted on this exhaust guide member 132 at a relatively forward portion thereof and fixed to it with bolts. In other words, a rear portion 143 of the exhaust guide member 132 is not affixed to the engine 32, specifically the cylinder head assembly 58, and hence projects rearwardly as a cantilever. The bottom cowling 48 also is affixed the exhaust guide member 132. The exhaust guide member 132 includes an exhaust guide section 140 that communicates with the exhaust manifold 94.

If the rear portion 143 and the cylinder head assembly 58 were to be joined together with each other, the cylinder head assembly 58 would be connected to both the cylinder body 50 and the exhaust guide member 132. This construction would make it quite difficult to position these components accurately due to respective tolerances. However, as described above, the exhaust guide member 132 is not connected to the cylinder head assembly 58, but is connected only to the cylinder body 50 in this embodiment. The cylinder head assembly 58, therefore, is required to have accuracy only at its front face that is connected to the cylinder body 50. This reduces the cost of the engine 32 in machining and assembling of its components.

The upper housing member 134 is placed between the exhaust guide member 132 and the lower housing member 136. The driveshaft 128 extends generally vertically through the exhaust guide member 132, upper housing member 134 and lower housing member 136 and down to the lower unit 42.

Figure 11:
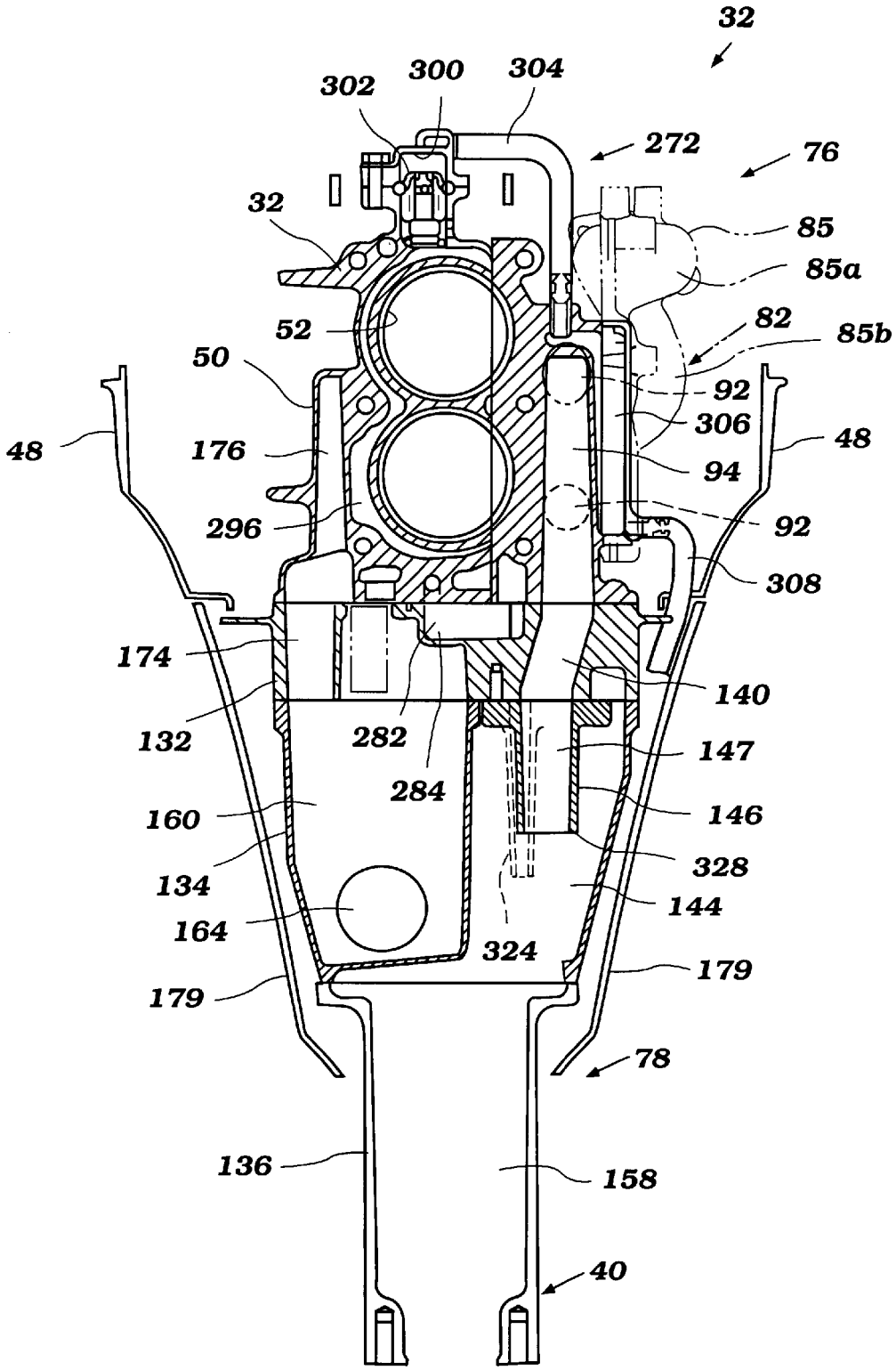
FIG. 11 is another cross-sectional rear view of the power head, the exhaust guide member and the driveshaft housing. The exhaust guide member and the driveshaft housing are sectioned along the line 11—11 in FIGS. 16 and 18. The engine is sectioned at two different facets and the left-hand half of the engine is sectioned to involve breather passages. The air intake system, exhaust ports and an exhaust pipe cooling conduit are illustrated in phantom.

As best seen in FIG. 11, an upper exhaust section 144 of the exhaust system 78 is defined between the exhaust guide member 132 and the upper housing member 134. In communication with the upper exhaust section 144, a lower exhaust section 158 is defined in the lower housing member 136. An exhaust pipe assembly 146 depends from the exhaust guide member 132 into the upper exhaust section 144. The exhaust pipe assembly 146 includes an exhaust pathway 147 therein which communicates with the exhaust guide section 140.

Figure 16:
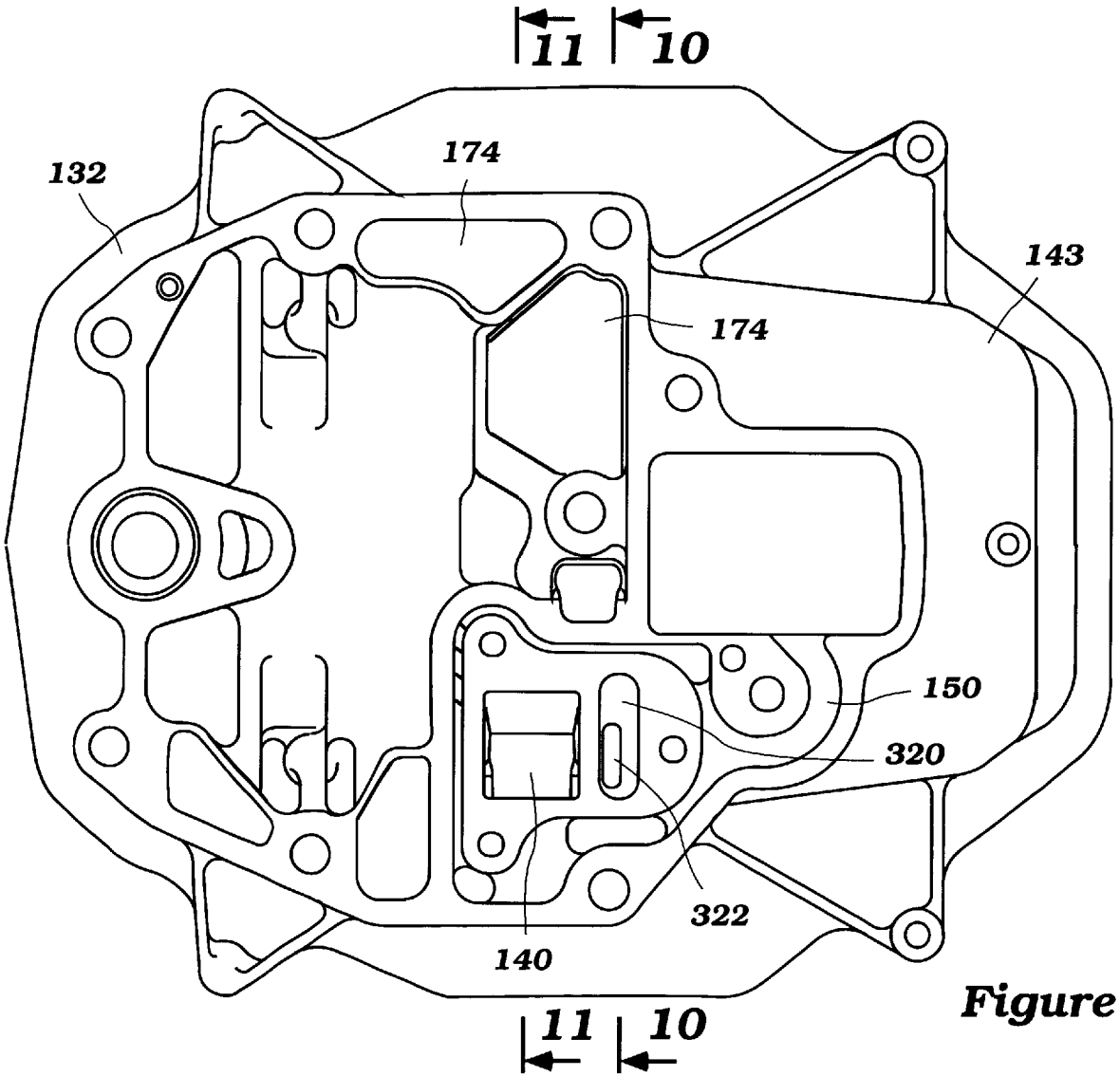
FIG. 16 is a bottom plan view showing the exhaust guide member.
Figure 17:
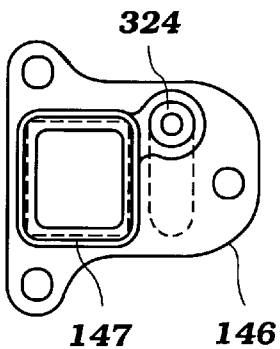
FIG. 17 is a bottom plan view showing an exhaust pipe assembly.
Figure 18:
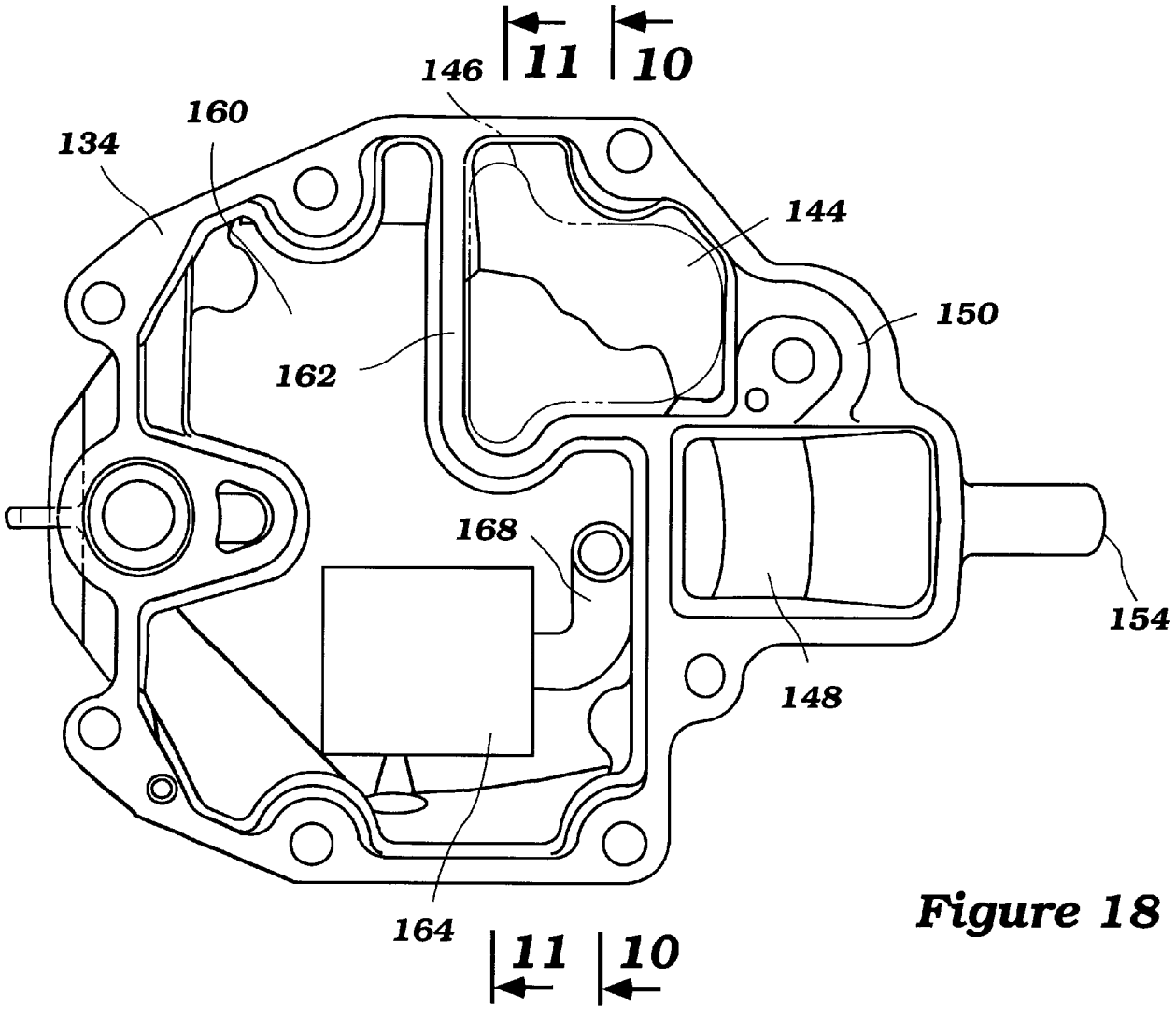
FIG. 18 is a top plan view showing an upper housing section of the driveshaft housing. The exhaust pipe assembly is indicated in phantom.

An idle exhaust expansion chamber 148 is also defined between the exhaust guide member 132 and the upper housing member 134. As seen in FIGS. 4, 16 and 18, an idle exhaust recess is further formed between them to define an idle exhaust passage 150 joining the idle exhaust expansion chamber 148 with the upper exhaust section 144. The idle expansion chamber 148, in turn, has an idle exhaust gas discharge port 154 at its rear portion. Thus, exhaust gasses from the combustion chambers 60 at idle speed go to the idle expansion chamber 148 from the upper exhaust section 144 through the idle exhaust passage 150. Then, the idle exhaust gasses are discharged to the atmosphere through the discharge port 154. Since the idle exhaust gasses are expanded in the idle expansion chamber 148, exhaust noise is sufficiently reduced.

Figure 3:
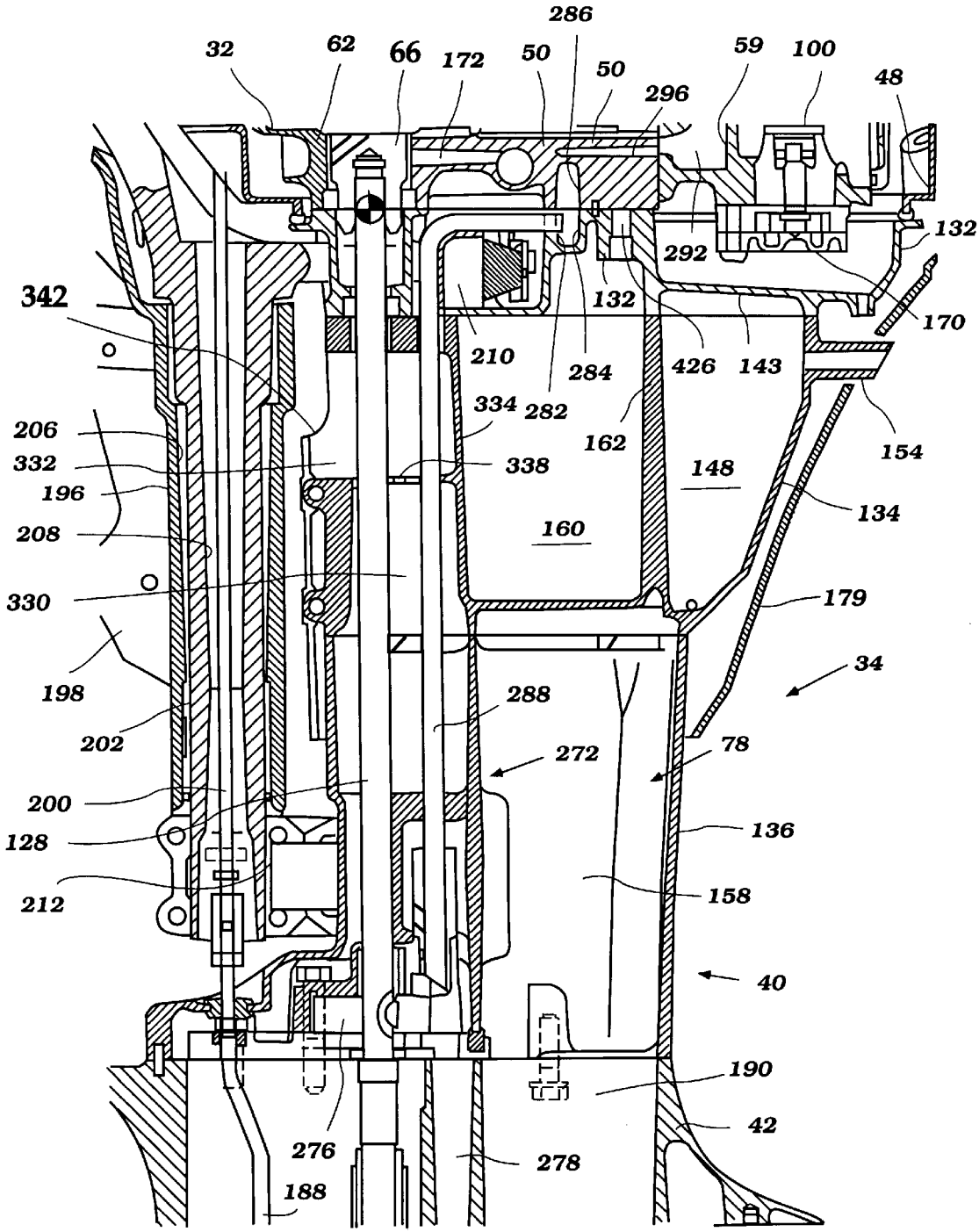
FIG. 3 is an enlarged cross-sectional, part side elevational view showing primarily a driveshaft housing of the outboard motor of FIG. 1.
Figure 7:
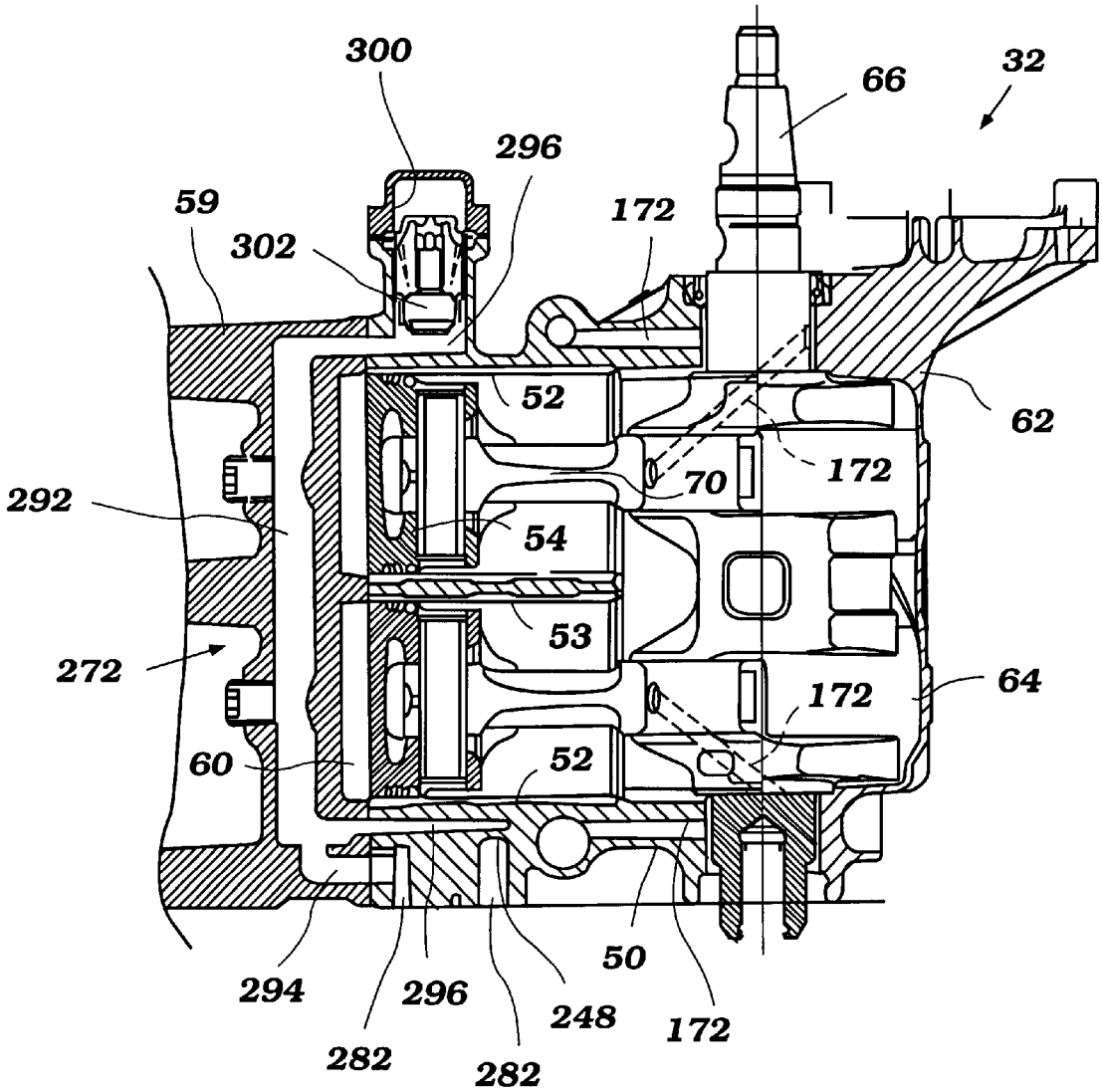
FIG. 7 is a cross-sectional side elevational view showing the engine. The cylinder head is partially cut away. A cooling jacket and passages are schematically illustrated to indicate some portions that are not really seen in this cross-section.

A lubricant reservoir 160 is defined between the exhaust guide member 132 and the upper housing member 134 and is spaced apart from the upper exhaust section 144 and the idle exhaust expansion chamber 148 by a partition wall 162. The lubricant reservoir 160 includes an oil filter or strainer 164 and a lubricant supply pipe 168 extending upwardly from the oil filter 164. The lubricant pipe 168 is connected to an oil pump 170 which is affixed to and driven by the lower end of the camshaft 100. As seen in FIGS. 3 and 7, the oil pump 170 is connected to oil supply passages 172. The oil passages 172, in turn, have access to, for example, some portions where the crankshaft 66 is journaled or is connected with the connecting rods 70. When the oil pump 170 is driven by the camshaft 100, the lubricant in the lubricant reservoir 160 is drawn up through the oil filter 164 and the lubricant pipe 168 to the oil pump 170 and then delivered to the engine portions that are required to be lubricated through the respective oil passages 172. After lubrication, the lubricant returns to the lubricant reservoir 160 by its own weight through return passages which are not shown.

Vapor or gaseous oil in the lubricant reservoir 160 can flow into the camshaft chamber 108 through breather passages 174, 176 (see FIG. 11) formed within the exhaust guide member 132 and cylinder body 50, respectively. The camshaft chamber 108 further communicates with the air intake section 80 by a breather pipe 177. An oil dip stick 178 is usually immersed in the reservoir 160 so that the operator may check the oil amount or see how dirty the lubricant is at any time.

An apron 179 made of synthetic resin encloses both sides and the rear of the exhaust guide member 132 and the upper housing member 134. The apron 179 is detachably affixed to the upper housing member 134. The apron 179 is not a structural member and is provided only for a good and neat appearance of the outboard motor 30. It can be produced with a low cost relative to a member made of metal material.

Figure 10:
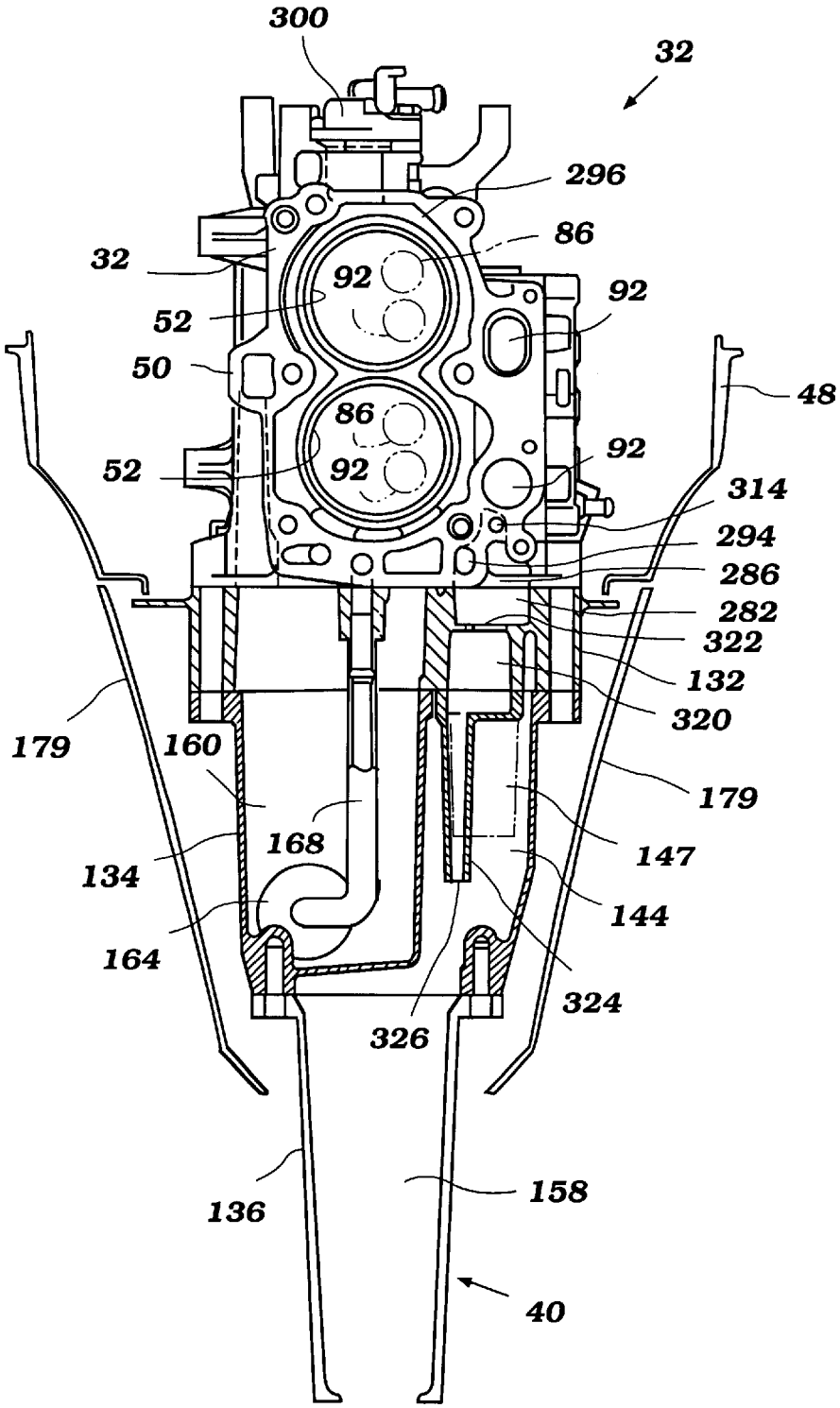
FIG. 10 is a cross-sectional rear view showing the power head, an exhaust guide member and the driveshaft housing. The exhaust guide member and driveshaft housing are sectioned along the line 10—10 in FIGS. 16 and 18. The engine is not sectioned.
Figure 19:
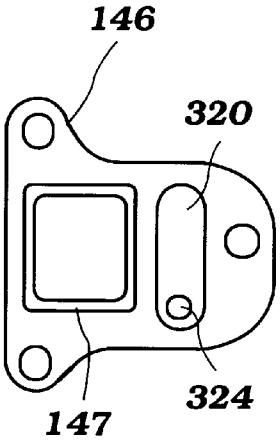
FIG. 19 is a top plan view showing the exhaust pipe assembly.
Figure 20:
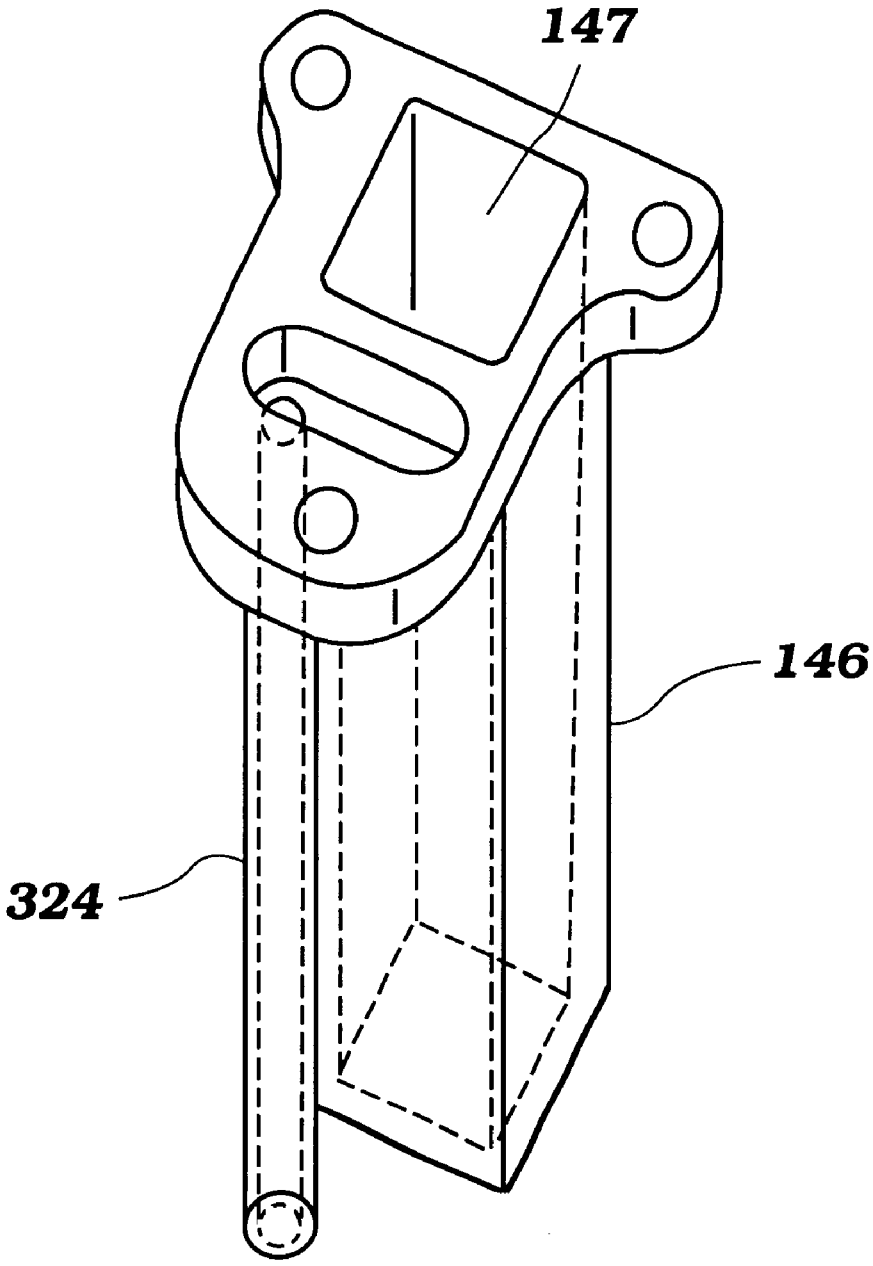
FIG. 20 is a perspective view showing the exhaust pipe assembly.

As seen in FIGS. 10, 11 and 19, the lubricant reservoir 160 is placed forward of the rear portion 143 of the exhaust guide member 132 that overhangs. The reservoir 160 is heavy when it is filled with lubricant. However, the heavy reservoir 160 is not supported on the rear portion 143. The rear portion 143 thus does not need to be reinforced to support such a heavy reservoir 160. Meanwhile, the lubricant reservoir 160 requires sufficient capacity. The reservoir 160 fully extends transversely in order to maximize its size in this direction to meet this requirement.

The lower unit 42 depends from the driveshaft housing 40, specifically the lower housing member 136, and supports a propeller shaft 180 which is driven by the driveshaft 128. The propeller shaft 180 extends generally horizontally through the lower unit 42. In the illustrated embodiment, the propulsion device includes a propeller 182 that is affixed to an outer end of the propeller shaft 180 and is driven thereby.

A transmission 184 is provided between the driveshaft 128 and the propeller 182. The transmission 184 couples together the two shafts 128, 180 which lie generally normal to each other (i.e., at a 90° shaft angle) with, for example, a bevel gear combination. The transmission 184 has a switchover mechanism 186 to shift rotational directions of the propeller 182 to forward, neutral or reverse. The switchover mechanism 186 includes a dog clutch and a shift cable disposed in the protective cowlings 46, 48. A shift rod assembly 188, which extends generally vertically, is also included in the switchover mechanism 186 to connect the dog clutch with the shift cable. The shift cable extends forwardly from the protective cowlings 46, 48 so as to be operated by the operator. Actually, the shift rod assembly 188 extends through a swivel bracket, which will be described shortly, and into the lower unit 42.

The lower unit 42 also defines an internal passage that forms a discharge section 190 of the exhaust system 78. The discharge section 190 of the lower unit 42 and the aforenoted upper and lower exhaust sections 144, 158 of the driveshaft housing 40 define an exhaust expansion chamber. At engine speed above idle, the majority of the exhaust gasses are discharged to the body of water surrounding the outboard motor 30 through the discharge section 190 and finally through a hub 192 of the propeller 182, as is well known in the art.

The bracket assembly 36 comprises a swivel bracket 196 and a clamping bracket 198. The swivel bracket 196 supports the drive unit 34 for pivotal movement about a generally vertically extending steering axis 200 which is an axis of a steering shaft 202 affixed to the driveshaft housing 40. The steering shaft 202 extends through a hollow 206 made within the swivel bracket 196. The steering shaft 202 itself has a hollow 208 and the aforenoted shift rod assembly 188 extends therethrough.

Figure 12:
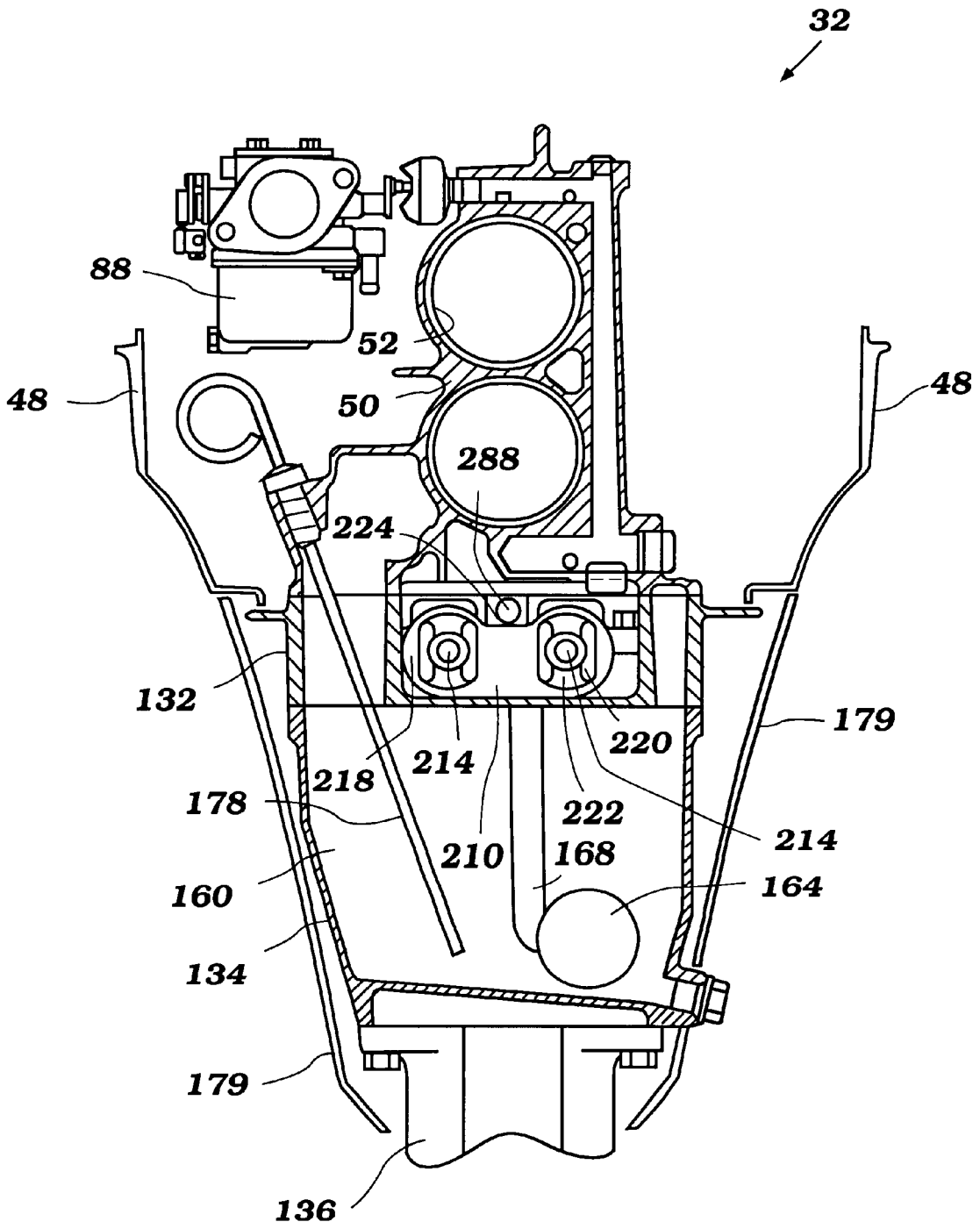
FIG. 12 is an enlarged, cross-sectional front view showing the power head, the exhaust guide and the upper part of the driveshaft housing. The cross-sectioned area in this figure is different from those of the former two figures and the exhaust guide member is sectioned along the line 12—12 in FIG. 15.
Figure 13:
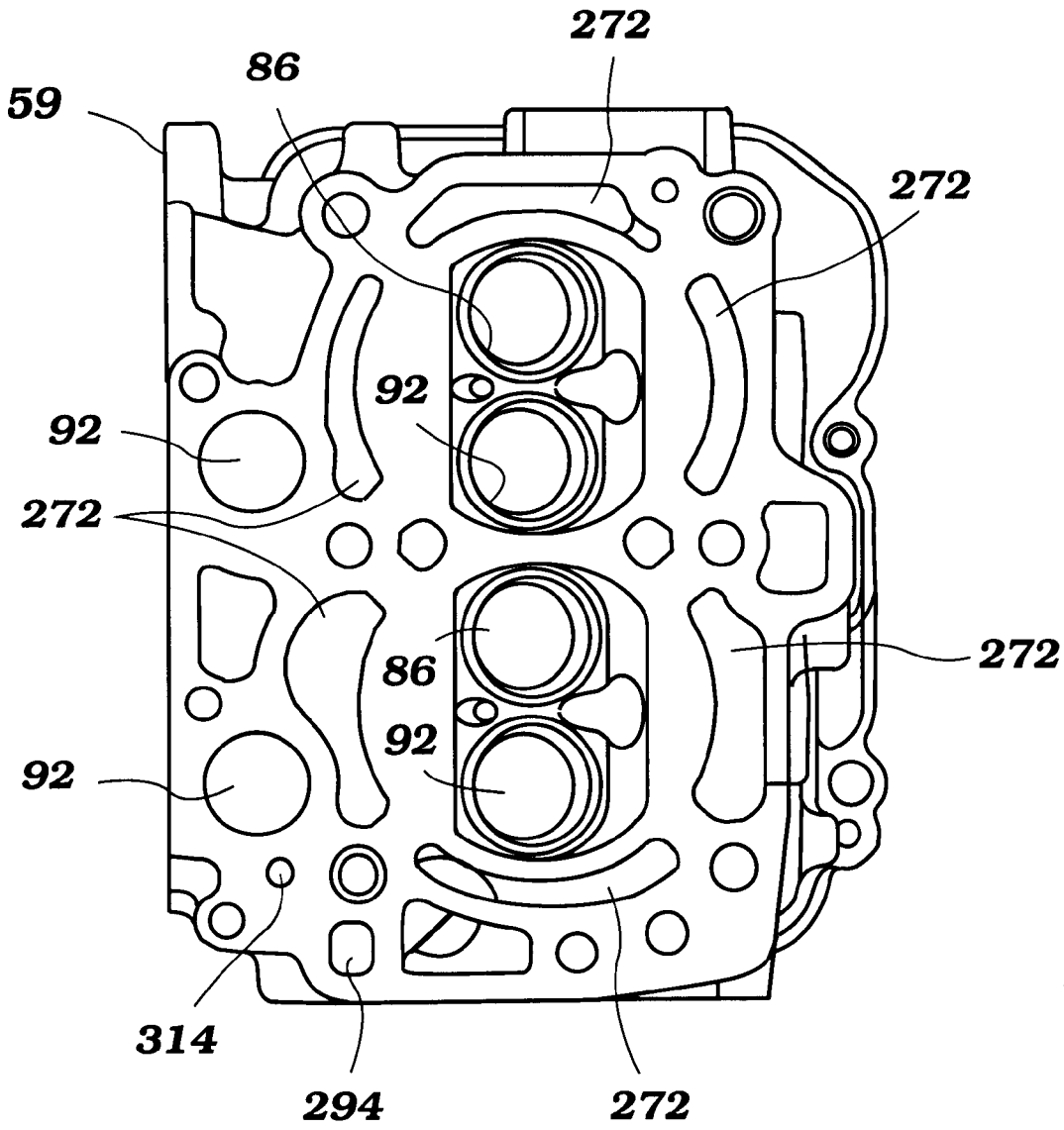
FIG. 13 is a front view showing the cylinder head.
Figure 14:
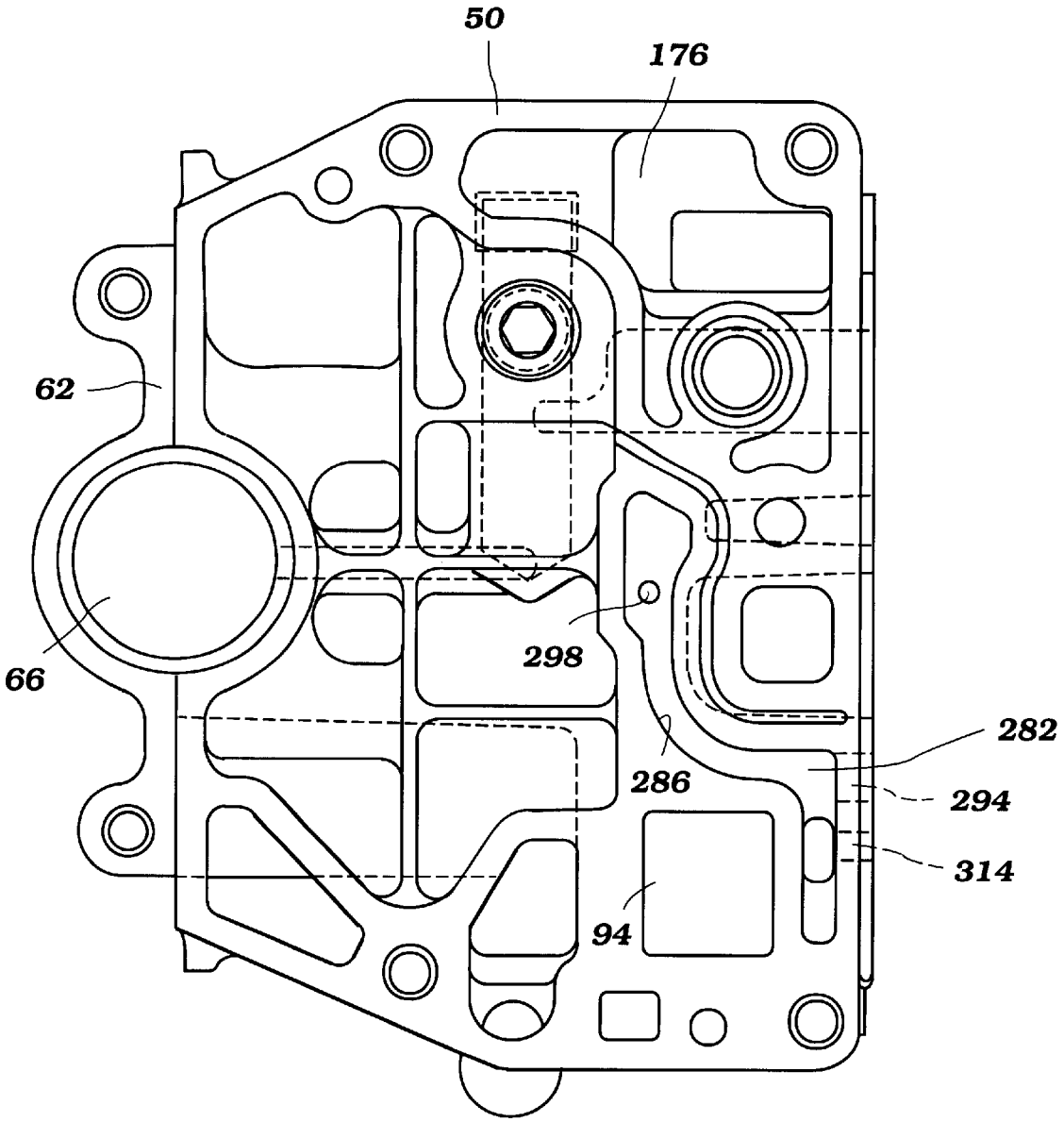
FIG. 14 is a bottom plan view showing a cylinder body and a crankcase member.
Figure 15:
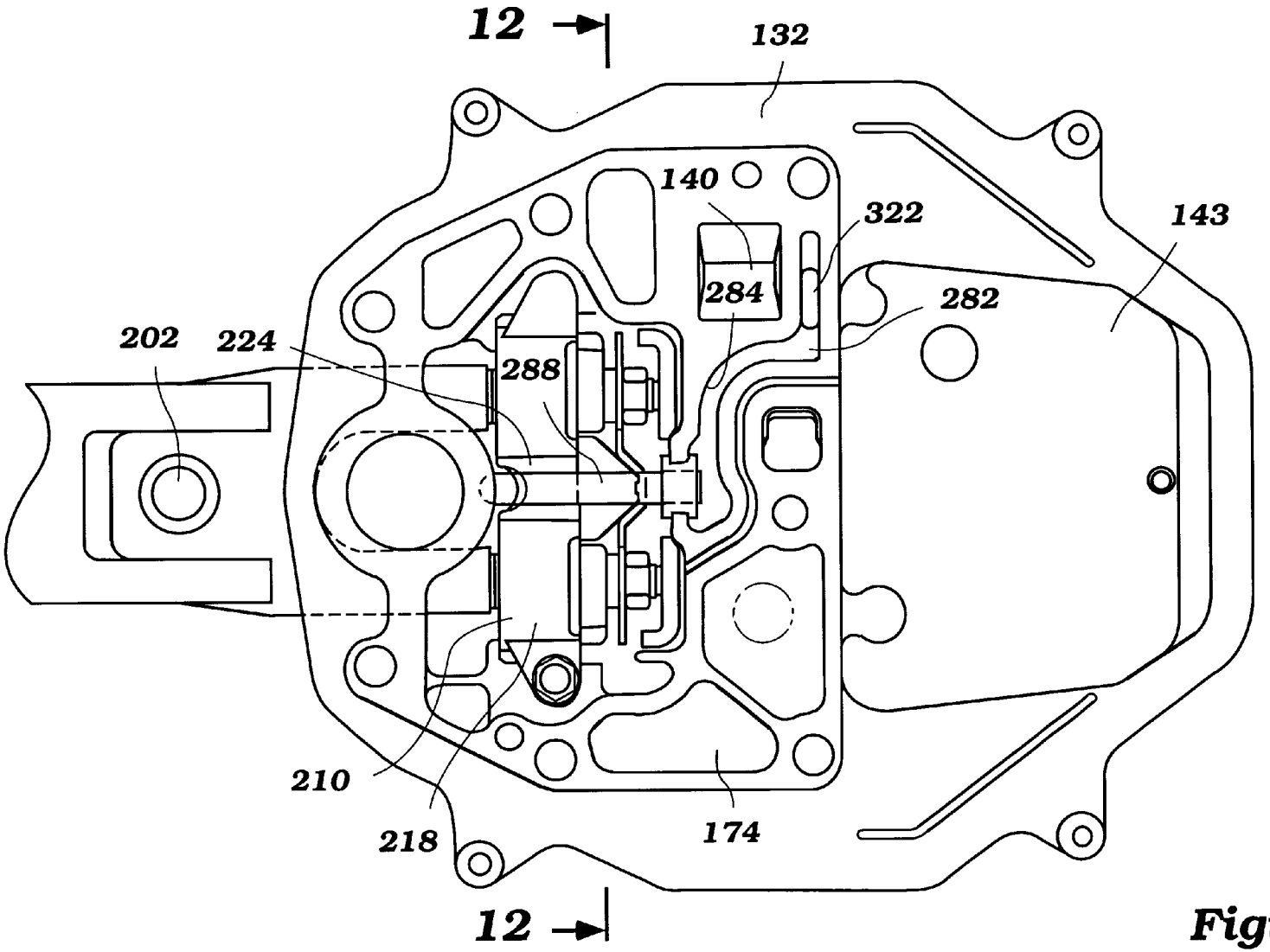
FIG. 15 is a top plan view showing the exhaust guide member.

The steering shaft 202 is affixed to the driveshaft housing 40 by an upper mount assembly 210 and a lower mount assembly 212. As seen in FIGS. 12 and 15, the upper mount assembly 210 comprises a pair of rods 214 affixed to the steering shaft 202, a mount member 218 having a pair of tubular sections 220 through which the rods 214 are inserted and elastic members 222 interposed between the tubular sections 220 and the rods 214. A recess 224 is formed at an upper surface of the mount member 218 between the tubular sections 220. The lower mount assembly 212 has a similar structure except the recess 224.

A steering bracket 228 extends generally upwardly and then forwardly from the steering shaft 202. A steering handle 230 is pivotally affixed onto the steering bracket 228. That is, as seen in FIG. 1, the steering handle 230 can take a working position shown in actual line and a folded-up position shown in phantom line by a pivotally shiftable folding mechanism 232. When the steering handle 230 is folded up, it extends along the port side wall of the top cowling 46. The operator can steer the outboard motor 30 when the steering handle 230 is in the working position. A throttle control lever may be also attached to the steering handle 230. The opening degree of the throttle valves in the carburetors 88 are remotely controlled by the throttle control lever.

The clamping bracket 198 is affixed to the transom 37 of the associated watercraft 38 and supports the swivel bracket 196 for pivotal movement about a generally horizontally extending tilt axis, i.e., the axis of a pivot shaft 238. The clamping bracket 198 includes a pair of members spaced apart laterally from each other. A thrust pin 240 is transversely provided between the spaced members. A lower front portion of the swivel bracket 196 contacts the thrust pin 240 and conveys thrust force by the propeller 192 to the associated watercraft 38.

As used throughout this description, the terms "fore," "forward," "front," and "forwardly" mean at or to the side where the clamping bracket 198 is located, and the terms "rear," "reverse," "back," and "rearwardly" mean at or to the opposite side of the front side, unless indicated otherwise. In addition, the terms "portside" and "starboard side" mean the left-hand side and the right-hand side, respectively, when looking forwardly.

Although a hydraulic tilt system can be provided between the swivel bracket 196 and the clamping bracket 198, this exemplary outboard motor 30 has no such system. The operator, therefore, tilts the motor 30 up or down for himself or herself. When the operator wants to hold the outboard motor 30 at the tilted up position, he or she may use a tilt pin (not shown) in a manner which is well known in the art.

The engine and its induction and exhaust systems will now be described in detail. Because the air induction system 76 and the exhaust system 78 are disposed on the same side of the engine 32, it is difficult to make the engine component. The problem is solved by employing the following arrangement in this embodiment.

Figure 6:
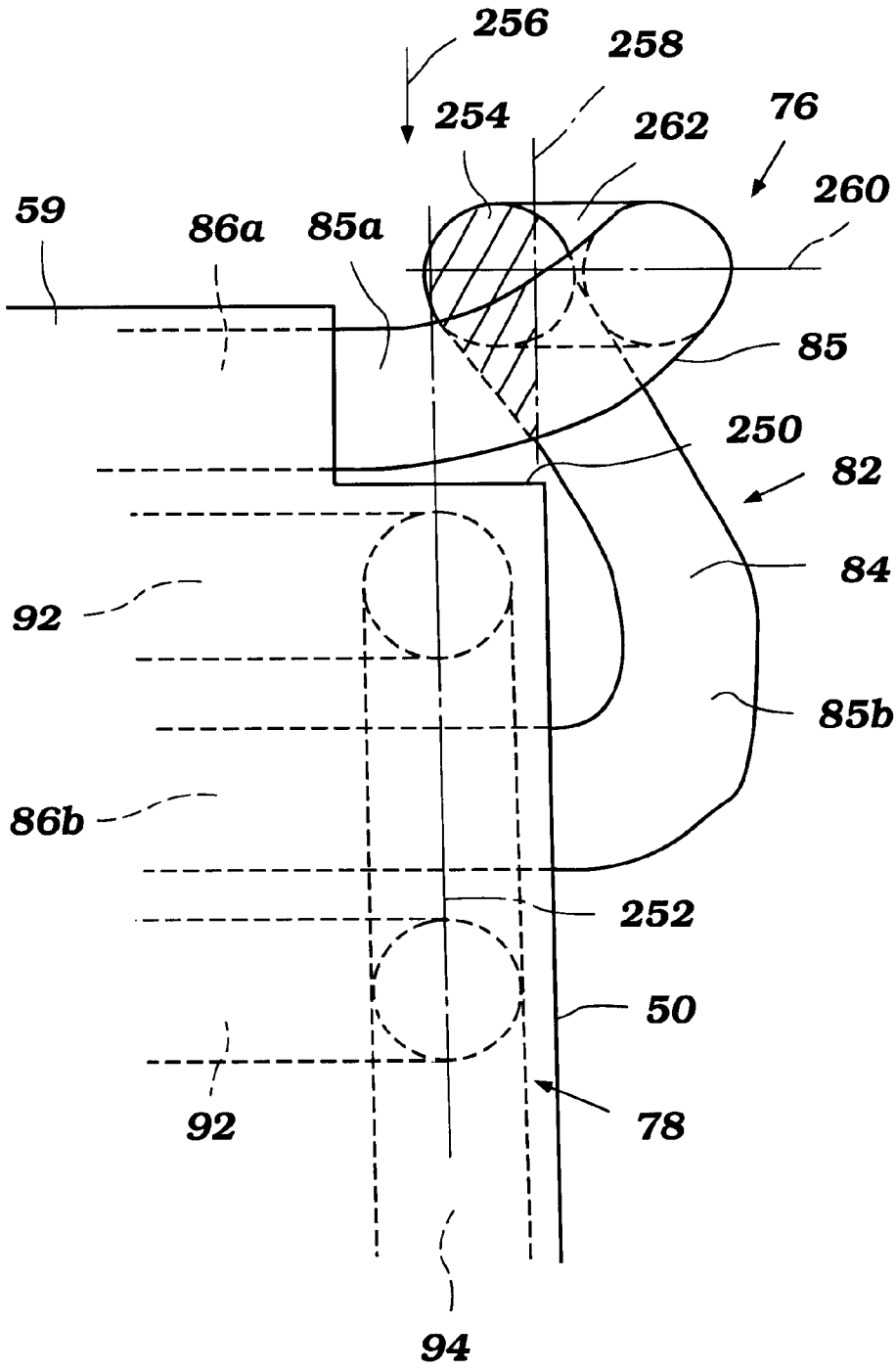
FIG. 6 is a schematic front view showing the arrangement of air intake passages and exhaust passages on the engine.

As best seen in FIG. 6, the exhaust manifold 94 extends generally along the cylinder body 50. In the illustrated embodiment, the exhaust manifold 94 is unified with the cylinder body 50 and has an upper end portion 250 in a direction of its axis 252. The exhaust manifold 94 communicates with the exhaust ports or exhaust passages 92 that extends from the cylinder head member 59 to the cylinder body 50. The lower intake port or inner portion 86*b* of the air intake passage 82 extends generally in between both exhaust ports 92 within the cylinder head member 59. Meanwhile, the upper intake port or inner portion 86*a* extends above the upper exhaust ports 92 within the cylinder head member 59. Both of the inner portions 86*a*, 86*b* are connected to the intake manifold 85 or intake runners 85*a*, 85*b*. The runner 85*b* has a passage portion 254 positioned adjacent to the end portion 250 of the exhaust manifold 94. The passage portion 254 is indicated with hatching in FIG. 6. The passage portion 254 overlaps with the exhaust manifold 94 in the direction along the axis 252 of the exhaust passage, as viewed in the direction of arrow 256 of FIG. 6, which aligns with the exhaust manifold axis. That is, the overlap exists to the left of the line 258 in the figure which extends from the outer end of the exhaust manifold 94.

The intake runners 85*a*, 85*b* of the air intake passages 82 are unified together at a unified portion 262 upstream of this overlap region of passage portion 254. Each intake runner 85*a*, 85*b* also extends between the overlap region and unified portion 262 such that this flow axes lie within a plan 260 that extends generally normal to the extending axis 252 of the exhaust manifold 94. The upper intake runner 85*a*, which is located nearer to the unified portion 262 than the lower intake runner 85*b*, is joined to the unified portion 262 at a position farther than that position at which the lower intake runner 85*b* is joined. In other words, both of the upper and lower outside sections 85*a*, 85*b* are crossed with each other.

The intake runners 85*a*, 85*b* unified together are aligned generally horizontally. That is, they are disposed side by side. Because of this arrangement, fuel may equally accumulate within both of the intake runners 85*a*, 85*b*, if any. An imbalanced delivery of fuel will not occur. In addition, upstream portions of the intake runners 85*a*, 85*b* are higher than downstream portions thereof. Thus, all of the deposited fuel, if any, will flow toward the combustion chambers 60 and not to the carburetors 88.

Since the passage portion 254 of the lower intake runner 85*b* is overlapped with the exhaust manifold 94 as described above, the air induction system 76 does not project so much from the cylinder head member 59 and cylinder body 50. Thus, even though the engine 32 employs such a counterflow arrangement, it is compact.

In addition, because of the crossed unification of the upper and lower intake runners 85*a*, 85*b*, the upper intake runner 85*a*, which is positioned closer to the unified portion 262 than the other intake runner 85*b*, can be connected to the engine body with a sufficient length. Therefore, the upper intake runner 85*a* can have a relatively large curvature and air charges can flow smoothly therethrough.

The outboard motor 30 has a cooling system 272 to cool down primarily the engine 32, particularly the cylinder body 50, the cylinder head assembly 58, and the exhaust system 78. Since the air induction system 76 has the inner sections or inner portions 86 in the cylinder head assembly 58, these sections are also cooled. This cooling system 272 will now be described below.

Because the cooling system 272 draws water as coolant from the body of water surrounding the outboard motor 30, it has a water inlet 274 disposed at a side of the lower unit 42 and a water pump 276 disposed at the lowermost portion of the lower housing member 136. A water inlet passage 278 is defined in the lower unit 42 and extends to the water pump 276 from the water inlet 274. Water delivery passages 282 are defined between upper recesses 284 formed in the exhaust guide member 132 and lower recesses 286 formed in the cylinder body 50. The water pump 276 and the delivery passages 282 are connected with each other by a water supply pipe 288. The water supply pipe 288 extends generally vertically and makes a right-angled turn at its top portion. Then, as seen in FIGS. 12 and 15, the supply pipe 288 extends generally horizontally on the recessed portion 224 of the upper mount member 218. The water inlet 274, the water inlet passage 278, the water supply pipe 288 and the water delivery passages 282 together define a water delivery passage.

As best seen in FIG. 7, one of the delivery passages 282 in the cylinder body 50 is connected to a combustion chamber cooling jacket 292 in the cylinder head member 59 through a conjunction passage 294. The combustion cooling jacket 292 is disposed around the combustion chambers 60 to cool their peripheral wall portions. Another delivery passage 282 is connected to a cylinder body cooling jacket 296 through an orifice 298. The cylinder bore cooling jacket 296 generally surrounds the cylinder bores 52 to cool down their peripheral wall portions. Actually, both of the combustion chamber cooling jacket 292 and the cylinder bore cooling jacket 296 are connected with each other and further connected to a thermostat chamber 300 placed atop of the cylinder body 50. A thermostat 302 is disposed in the thermostat chamber 300. The thermostat 302 is a coolant flow control mechanism and when water temperature is lower than a predetermined temperature it prevents water from flowing downstream.

As best seen in FIG. 11, an outlet of the thermostat chamber 300 is connected to a first discharge conduit 304. Then, the first discharge conduit 304 is connected to a discharge jacket 306 defined in the cylinder body 50 and further to a second discharge conduit 308. The second discharge conduit 308 is lead to a space between the driveshaft housing 40 and the apron 179. The outlet of the second conduit 308 is opened to the space. In the illustrated embodiment, the combustion chamber cooling jacket 292, the conjunction passage 294, the cylinder body cooling jacket 296, the orifice 298, the thermostat chamber 300, the first discharge conduit, the discharge jacket 306 and the second discharge conduit 308 together define a first cooling water passage. The first cooling water passage, however, can comprise fewer or additional passages and conduits, but preferably flows through the cylinder body.

In the meantime, as seen in FIG. 9, a conjunction passage 314 is branched off from one of the water delivery passages 282 and is connected to an intake and exhaust cooling jacket 316. The conjunction passage 314 extends from the cylinder body 50 to the cylinder head member 59. As best seen in FIG. 5, this cooling jacket 316 is disposed to overlap with the lower inner portion 86*b* and the both exhaust ports 92 but not overlap with the upper inner portion 86*a*. In other words, the cooling jacket 316 covers only outside of the lower inner portion 86*b* but not covers the upper inner portion 86*a*. A pilot water discharge pipe 318 (see FIG. 9) extends from the inlet and exhaust cooling jacket 316. The water flowing through the cooling jacket 316 in part diverges to the pilot or telltale pipe 318 and flows out of the outboard motor 30 through an outlet opening (not shown) to indicate that certain water surely flows through the cooling system 272. The conjunction passage 314, the intake and exhaust cooling jacket 316 and the pilot water discharge pipe 318 together define a second cooling water passage. The second cooling water passage, however, can comprise fewer or additional passages and conduits, but preferably flows in proximity to the inner section of the intake passages.

There is no thermostat in this second water passage. This means that the thermostat 302 is arranged to permit the cooling water flowing through both of the first and second water passages, and the thermostat 302 prevents only the water within the first water passage from flowing therethrough when temperature of the water is lower than a preset temperature.

Further, as best seen in FIG. 10, one of the water delivery passages 282 is branched off to an exhaust pipe cooling passage 320 through an opening 322. The cooling passage 320 is then connected to an exhaust pipe cooling conduit 324. The cooling conduit 324 is formed uniformly with the exhaust pipe assembly 146 in this embodiment. However, it is of course can be separately formed. The cooling conduit 324 has a discharge opening 326 at the lowermost portion thereof and it is located lower than an opening 328 of the exhaust pathway 147. The exhaust pipe cooling passage 320, the opening 322 and the exhaust pipe cooling conduit 324 together define a third cooling water passage. The third cooling water passage, however, can comprise fewer or additional passages and conduits.

As best seen in FIG. 3, the cooling system 272 additionally includes a cooling sink comprising water reservoir sections 330, 332. These reservoir sections 330, 332 are defined in a fore part of the driveshaft housing 40 and parted from the exhaust sections 158, 190 and the lubricant reservoir 160 by a partition wall 334. That is, the water reservoir sections 330, 332 are separated from the exhaust sections 158, 190 and the lubricant reservoir 160 with a partition wall 334 but adjacent to them. This structure is advantageous because the water in the reservoir sections 330, 332 can cool the exhaust sections 158, 190 and the lubricant reservoir 160. A partition wall 338 extends generally horizontally to divide the reservoir sections 330, 332 but still they are connected with each other by openings through which the water supply pipe 288 and the driveshaft 128 extend. The water in the reservoir sections 330, 332 is supplied from the water pump 276, it exudes therefrom rather than be supplied by the pumping action of the water pump 276. The water reservoir section 332 has a dam 342 and the water in the reservoir sections 332, 330 can overflows into a space defined between a forward portion of the driveshaft housing 40 and the swivel bracket 196.

Cooling water is, therefore, pumped by the water pump 276 into the water inlet passage 278 through the water inlet 274 and then goes up to the water delivery passages 282 through the water supply pipe 288. The water exudes in part from the water pump 276 and goes to the water reservoir sections 330, 332. Then, it overflows into the space defined between the driveshaft housing 40 and the swivel bracket 196.

The majority of the water is supplied to the water delivery passages 282. Some of the water is then delivered to the first cooling water passage including the combustion chamber cooling jacket 292 and the cylinder body cooling jacket 296 to cool down the cylinder head member 59 around the combustion chambers 60 and the cylinder body 50 around the cylinder bores 52. In this first water passage, as described above, the thermostat 302 is provided in the thermostat chamber 300 and controls the water flow therein based upon a temperature of the water. When the water temperature is lower than a predetermined temperature, the thermostat 302 prevents the water from flowing therethrough. Thus, the cylinder head member 59 and the cylinder body 50 are not excessively cooled. When the water temperature is higher than the predetermined temperature, the thermostat 302 permits the water flow therethrough. The water then flows to the first discharge conduit 304 and flows through the discharge passage 306. The water then passes through the second discharge conduit 308 and it is discharged to the space between the driveshaft housing 40 and the apron 179. The water finally returns to the body of water surrounding the outboard motor 30. That is, the discharge water bypasses the exhaust guide member 174 and no particular water discharge portion for the first cooling water passage is necessary in the exhaust guide member 174. The exhaust guide member 174, therefore, may have a more simple structure and manufacturing costs thereof can be reduced. In addition, the water discharge portion from the second discharge conduit 308 is covered by the apron 178, so even if it becomes dirty the outboard motor maintains a good appearance. The appearance of the water discharge portion on the driveshaft housing 40 does never affect the whole appearance of the outboard motor 30 anyway.

Some portion of water, in turn, is delivered to the second cooling water passage that includes the intake and exhaust cooling jacket 316 and cools both the exhaust ports 92 and the lower inner portion 86*b* lying between the exhaust ports 92. Then, the water is discharged outside of the motor 30 through certain passages which are not shown. As described above, because the lower inner portion 86*b* is heated by the exhaust ports 92, it requires more cooling than the upper inner portion 86*a*.

The second cooling water passage in this embodiment has the cooling jacket 316 in proximity to the lower inner portion 86*b* and fresh water is supplied to this jacket 316 directly from the delivery passages 282. Thus, the lower inner portion 86*b* is well cooled and the temperature of this portion 86*b* can be almost the same as the temperature of the upper inner portion 86*a* that is not cooled by the cooling jacket 316. Additionally, because there is no thermostat provided in this second cooling water passage, water can always flow through this second cooling passage. The cooling system 272 in this embodiment thus does not need a pressure relief valve for protecting the water pump 276 from possible excessive pressure.

Another portion of the water in the delivery passages 282 goes to the third cooling water passage that includes the exhaust pipe cooling conduit 324 to cool the exhaust pipe assembly 146. The water then goes to the exhaust section 144 from the discharge opening 326 of the cooling conduit 324 and further to the other exhaust sections 158, 190. It is finally discharged outside through the propeller hub 192. In this process, the respective exhaust sections 144, 158, 190 are well cooled by the water flowing therethrough. Since the cooling conduit 324 has the discharge opening 326 at the lowermost portion thereof and it is located lower than the opening 328 of the exhaust pipe assembly 146, the water discharged from the opening 326 cannot enter the opening 328. This is advantageous because no cooling water may enter to the combustion chambers 60 through the exhaust system 78. Further, since fresh water is supplied to this third water passage directly from the delivery passages 282, the exhaust pipe 146 can be cooled significantly by the water that has a relatively low temperature.

As described above, the engine 32 has the counter-flow type arrangement. The air intake system 76 and the exhaust system 78 are disposed on the starboard side. Since the other side, i.e., portside, has a relatively large space, the other engine components, particularly, electrical devices can be easily placed on this side.

Also, the steering handle 230 is placed on the portside during it is folded up as noted above. When the operator lays the outboard motor 30 on the ground, he or she necessarily puts the steering handle 230 down. This means that the air intake system 76 and the exhaust system 78 turn upward. Thus, fuel and lubricant are prevented from accumulating therein when the motor 30 lies in this position.

In addition, usually the shift cable for operating the transmission switchover mechanism 186 is positioned on the portside, while a remote control cable for controlling the throttle valves is positioned on the starboard side. The location of the carburetors 88 on the starboard side in this arrangement is convenient for disposing the remote control cable.

Of course, the foregoing description is that of a preferred embodiment of the invention, and various changes and modifications may be made without departing from the spirit and scope of the invention, as defined by the appended claims.

What is claimed is:

1. An internal combustion engine comprising a cylinder body defining a plurality of cylinder bores in which pistons reciprocate, a cylinder head affixed to an end of said cylinder body and defining combustion chambers with said pistons and said cylinder bores, a plurality of air intake passages supplying air charges to said combustion chambers, said air intake passages including inner sections entirely defined within said cylinder head and outer sections disposed outside of said cylinder head and not being cast with said cylinder head, a plurality of exhaust passages discharging burnt charges from said combustion chambers, an exhaust manifold collecting the burnt charges from said exhaust passages, said exhaust manifold extending generally along said cylinder body and having an end portion in a direction of its extending axis, at least one of said outer sections of said air intake passages having a passage portion positioned adjacent to said end portion of said exhaust manifold, and said passage portion being overlapped with said exhaust manifold in a view along the extending axis.

2. An internal combustion engine as set forth in claim 1, wherein said exhaust manifold is defined within said cylinder body.

3. An internal combustion engine as set forth in claim 1, wherein said exhaust passages are defined at least within said cylinder head.

4. An internal combustion engine as set forth in claim 1, wherein said outer sections of the air intake passages are unitarily formed in part to define a unitary portion.

5. An internal combustion engine as set forth in claim 4, wherein said unitary portion includes said passage portion at least in part.

6. An internal combustion engine as set forth in claim 1, wherein the respective outer sections of the air intake passages lie generally side-by-side along an axis extending generally normal to said extending axis of said exhaust manifold.

7. An internal combustion engine as set forth in claim 6, wherein said outer sections cross each other so as to lie side-by-side.

8. An internal combustion engine as set forth in claim 1, wherein said outer sections of the air intake passages are unitarily formed in part, and the rest of the intake passages are separately formed so as to have different lengths from each other.

9. An internal combustion engine as set forth in claim 1, wherein said cylinder bores extend generally horizontally and are spaced apart from each other generally vertically.

10. An internal combustion engine as set forth in claim 9, wherein said outer sections of the air intake passages are unitarily formed in part so as to extend generally horizontally.

11. An internal combustion engine as set forth in claim 9, wherein said outside portions of the air intake passages are joined together at a unified portion, and the unified portion extends generally in a horizontal direction.

12. An internal combustion engine as set forth in claim 1, wherein said air intake passages and said exhaust passages are disposed generally on the same side of said engine.

13. An internal combustion engine as set forth in claim 1 additionally comprising a cooling system supplying coolant at least to said cylinder body and to said cylinder head, wherein said cooling system includes a first coolant passage disposed at least within said cylinder body, a second coolant passage disposed in proximity to said inner sections of the air intake passages within said cylinder head, and a coolant flow control mechanism arranged to permit the coolant flowing through both of said first and second coolant passages, said coolant flow control mechanism is configured to prevent only the coolant within said first coolant passage from flowing therethrough when temperature of the coolant is lower than a preset temperature.

14. An internal combustion engine as set forth in claim 1 additionally comprising a cooling system supplying coolant at least to said cylinder body and to said cylinder head, wherein said cooling system includes a first coolant passage disposed within said cylinder body and a second coolant passage disposed in proximity to said inner sections of the air intake passages within said cylinder head, at least one of said intake passages is disposed between said exhaust passages, and said second coolant passage is positioned closer to the intake passage, which is disposed between said exhaust passages, than to the other intake passages which is not disposed between said exhaust passages.

15. An internal combustion engine as set forth in claim 1, wherein said engine operates on a four stroke combustion principle.

16. An internal combustion engine as set forth in claim 1, adapted to propel a watercraft, wherein said engine powers a marine propulsion device for the watercraft.

17. An internal combustion engine as set forth in claim 1 additionally comprising a crankshaft rotating with the reciprocal movement of said pistons, valve mechanism arranged to selectively open and close said intake and exhaust passages, a valve drive mechanism arranged to couple the valve mechanism with the crankshaft so as to drive the valve mechanism by said crankshaft, wherein said passage portion is positioned between the valve drive mechanism and the end portion of said exhaust manifold.

18. An internal combustion engine comprising a cylinder body defining a plurality of generally horizontal cylinder bores in which pistons reciprocate, the cylinder bores being spaced apart along a vertical direction, a cylinder head affixed to an end of said cylinder body and defining combustion chambers with said pistons and said cylinder bores, a plurality of air intake passages supplying air charges to said combustion chambers, said air intake passages including inner sections defined within said cylinder head and outside sections disposed outside of said cylinder head, a plurality of exhaust passages discharging burnt charges from said combustion chambers, an exhaust manifold collecting the burnt charges from said exhaust passages, said exhaust manifold extending generally along said cylinder body and having an end portion in a direction of its extending axis, at least one of said outside sections of said air intake passages having a passage portion positioned adjacent to said end portion of said exhaust manifold, and said passage portion being overlapped with said exhaust manifold in a view along the extending axis, wherein said end portion of said exhaust manifold is positioned atop thereof, said outside sections of the air intake passages are unified together with each other to define a unified portion in proximity to said end portion, one of said outside sections, which is located higher than another one of said outside sections, is joined to said unified portion at a position farther upstream than another position at which said other one of said outside sections is joined.

19. An internal combustion engine as set forth in claim 18, wherein the respective outer sections lie side-by-side generally horizontally, said separate portions of the outer sections cross each other so that a shorter separate portion is positioned farther from the extending axis of the exhaust manifold than another separate portion.

20. An internal combustion engine comprising a cylinder body defining at least one cylinder bore in which a piston reciprocates, a cylinder head affixed to an end of said cylinder body and defining at least one combustion chamber with said piston and said cylinder bores, an air intake passage supplying an air charge to said combustion chamber, said air intake passage including an inner section defined within said cylinder head, a cooling system supplying coolant at least to said cylinder body and to said cylinder head, said cooling system including a first coolant passage defining at least a combustion chamber cooling jacket, a second coolant passage defining a second cooling jacket which does not define a part of the combustion chamber cooling jacket, and a coolant flow control mechanism arranged to permit coolant to flow through both of said first and second coolant passages, said coolant flow control mechanism including a thermostat positioned within said first coolant passage and configured to prevent only the coolant within said first coolant passage from flowing therethrough when temperature of the coolant in the first coolant passage is lower than a preset temperature.

21. An internal combustion engine as set forth in claim 20 additionally comprising an exhaust passage discharging the burnt charge from said combustion chamber.

22. An internal combustion engine as set forth in claim 21, wherein said air intake passage and said exhaust passage are disposed on the same side of said engine relative to said combustion chamber.

23. An internal combustion engine as set forth in claim 21 in combination with an outboard motor, wherein said engine is incorporated within said outboard motor, said outboard motor includes an exhaust guide member on which said engine is disposed , said exhaust guide member communicates with said exhaust passage to permit the burnt charge passing therethrough, and a coolant discharge passage communicating with said first coolant passage is arranged to bypass said exhaust guide member.

24. An internal combustion engine as set forth in claim 23, wherein said coolant discharge passage is disposed outside of said exhaust guide member.

25. An internal combustion engine as set forth in claim 21 in combination with a n outboard motor, where in said engine is incorporated within said outboard motor, said outboard motor includes an exhaust guide member on which said engine is disposed, said exhaust guide member includes an exhaust guide section communicating with said exhaust passage to permit the burnt charge flowing therethrough, said cooling system includes a third coolant passage, at least in part, located in proximity to said exhaust guide section.

26. An internal combustion engine as set forth in claim 25, wherein said third coolant passage is defined at least in part in said exhaust guide member.

27. An internal combustion engine as set forth in claim 21, wherein said engine comprises a plurality of said cylinder bores, a plurality of said air intake passages and a plurality of said exhaust passages, at least one of said intake passages is disposed between said exhaust passages, and said second coolant passage is positioned closer to said intake passage, which is disposed between said exhaust passages, than to the other intake passages which are not disposed between said exhaust passages.

28. An internal combustion engine as set forth in claim 20 in combination with an outboard motor, wherein said engine is incorporated within said outboard motor, said outboard motor includes a water pump to introduce water existing outside of the outboard motor as the coolant to both of said first and second coolant passages.

29. An internal combustion engine as set forth in claim 20 adapted to propelling a watercraft, wherein said cooling system includes an open channel arranged to introduce water existing outside of the watercraft as the coolant and to discharge the water outside of the watercraft.

30. An internal combustion engine as set forth in claim 20, wherein the first cooling jacket defines a cooling jacket for the inner section of the air intake passage.

* * * * *